US007257949B2

(12) United States Patent
Shimizu et al.

(10) Patent No.: US 7,257,949 B2
(45) Date of Patent: Aug. 21, 2007

(54) STIRLING ENGINE

(75) Inventors: Katsumi Shimizu, Takatsuki (JP); Naoki Nishi, Wakayama (JP); Haruhiko Murakami, Hirakata (JP); Toshiaki Hosono, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 280 days.

(21) Appl. No.: 10/499,706

(22) PCT Filed: Dec. 24, 2002

(86) PCT No.: PCT/JP02/13458

§ 371 (c)(1),
(2), (4) Date: Jun. 21, 2004

(87) PCT Pub. No.: WO03/056257

PCT Pub. Date: Jul. 10, 2003

(65) Prior Publication Data

US 2005/0039454 A1 Feb. 24, 2005

(30) Foreign Application Priority Data

| | | |
|---|---|---|
| Dec. 26, 2001 | (JP) | 2001-394256 |
| Jan. 8, 2002 | (JP) | 2002-001731 |
| Feb. 25, 2002 | (JP) | 2002-047570 |
| Oct. 7, 2002 | (JP) | 2002-293191 |

(51) Int. Cl.

| | |
|---|---|
| ***F25B 9/14*** | (2006.01) |
| ***F25B 9/00*** | (2006.01) |
| ***F02G 1/043*** | (2006.01) |
| ***F02G 1/04*** | (2006.01) |

(52) U.S. Cl. ..... 60/517; 60/520; 60/523; 60/524; 62/6

(58) Field of Classification Search ..... 60/517, 60/520, 523, 524; 62/6; *F25B 9/14*
See application file for complete search history.

(56) References Cited

U.S. PATENT DOCUMENTS

| | | | | |
|---|---|---|---|---|
| 4,389,849 | A * | 6/1983 | Beggs et al. | 62/6 |
| 4,475,346 | A * | 10/1984 | Young et al. | 62/6 |
| 4,642,547 | A | 2/1987 | Redlich | 60/520 |
| 5,088,288 | A * | 2/1992 | Katagishi et al. | 62/6 |
| 5,897,296 | A * | 4/1999 | Yamamoto et al. | 417/44.1 |
| 6,050,092 | A | 4/2000 | Genstler et al. | 60/520 |
| 6,084,320 | A * | 7/2000 | Morita et al. | 62/6 |
| 6,094,912 | A * | 8/2000 | Williford | 60/520 |

(Continued)

FOREIGN PATENT DOCUMENTS

EP 1348918 A1 * 10/2003

(Continued)

*Primary Examiner*—Sheldon J Richter
(74) *Attorney, Agent, or Firm*—Birch, Stewart, Kolasch & Birch, LLP

(57) ABSTRACT

Through stroke control whereby the stroke of a piston is detected and controlled to be equal to a target stroke, the piston is prevented from colliding with a displacer, and the refrigerating performance of a Stirling refrigerator is enhanced. Different target strokes corresponding to different operation conditions of the Stirling refrigerator are stored in a storage portion in a control box, so that a linear motor can be driven with a target stroke that suits the current operation condition. Thus, the piston is prevented from colliding with a displacer, and the refrigerating performance of a Stirling refrigerator is further enhanced.

6 Claims, 18 Drawing Sheets

U.S. PATENT DOCUMENTS

| | | | | |
|---|---|---|---|---|
| 6,199,381 | B1 * | 3/2001 | Unger et al. | 60/520 |
| 6,809,486 | B2 * | 10/2004 | Qiu et al. | 318/135 |
| 6,812,597 | B2 * | 11/2004 | McGill et al. | 310/12 |
| 6,843,057 | B2 * | 1/2005 | Yamamoto | 60/520 |
| 6,851,934 | B2 * | 2/2005 | Yoo et al. | 417/44.11 |
| 6,871,495 | B2 * | 2/2005 | Lynch et al. | 60/522 |
| 6,920,967 | B2 * | 7/2005 | Wood | 188/380 |
| 6,954,040 | B2 * | 10/2005 | McGill et al. | 318/127 |
| 2002/0121816 | A1 * | 9/2002 | Qiu et al. | 310/51 |
| 2004/0055314 | A1 * | 3/2004 | Shimizu et al. | 62/6 |

FOREIGN PATENT DOCUMENTS

| | | | |
|---|---|---|---|
| JP | 6-74588 | A | 3/1994 |
| JP | 6-89960 | B2 | 11/1994 |
| JP | 8-5178 | A | 1/1996 |
| JP | 10-253184 | A | 9/1998 |
| JP | 11-132585 | A | 5/1999 |
| JP | 11-304270 | A | 11/1999 |
| JP | 2000-304366 | A | 11/2000 |
| JP | 2000-346476 | A | 12/2000 |
| JP | 2003314919 | A * | 11/2003 |
| WO | WO 2053991 | A1 * | 7/2002 |

* cited by examiner

FIG.8

HEAT-REJECTING PORTION TEMPERATURE → UP

COOLING PORTION TEMPERATURE ↓ DOWN

| | | | | | |
|---|---|---|---|---|---|
| V1 | V2 | V3 | V4 | V5 | V41 |
| V6 | V7 | V8 | V9 | V10 | V42 |
| V11 | V12 | V13 | V14 | V15 | V43 |
| V16 | V17 | V18 | V19 | V20 | V44 |
| V21 | V22 | V23 | V24 | V25 | V45 |
| V26 | V27 | V28 | V29 | V30 | V46 |
| V31 | V32 | V33 | V34 | V35 | V47 |
| V36 | V37 | V38 | V39 | V40 | V48 |

: SAFE OPERATION REGION

: DANGEROUS OPERATION REGION

Vn : MICROCOMPUTER OUTPUT VOLTAGE DATA

STIRLING ENGINE

TECHNICAL FIELD

The present invention relates to a Stirling engine, and particularly to a free-piston-type Stirling engine.

BACKGROUND ART

In recent years, much attention has been paid to Stirling engines because they are energy-saving, environment-friendly, and advantageous from other viewpoints. A Stirling engine is an external combustion engine that realizes the Stirling cycle, a reversible cycle, by the use of an external heat source, and is thus an advantageously energy-saving, low-pollution heat engine as compared with an internal combustion or other engine that requires a highly flammable, ignitable fuel such as gasoline. One widely known form of application of such Stirling engines is Stirling refrigerators.

Conventionally, refrigerators and the like typically adopt a refrigerating cycle based on vapor compression. The vapor compression refrigerating cycle employs a refrigerant such as a CFC (chlorofluorocarbon) as a working medium, and achieves desired refrigerating performance by exploiting the condensation and evaporation of the CFC.

However, CFCs used as refrigerants are chemically highly stable, and are believed to reach the stratosphere and destroy the ozone layer when discharged into the atmosphere. For this reason, in recent years, use and production of particular types of CFC have been increasingly restricted. Under these circumstances, much attention has been paid to a refrigerating cycle based on the reverse Stirling cycle as a replacement for a refrigerating cycle employing a CFC.

The reverse Stirling refrigerating cycle employs helium gas, hydrogen gas, nitrogen gas, or the like as a working medium, and thus has no bad effects on the global environment. Stirling refrigerators exploiting the reverse Stirling refrigerating cycle are known to be compact refrigerators that produce cryogenic low temperature.

A Stirling refrigerator is composed of a combination of a compressor that compresses a refrigerant gas used as a working medium and an expander that expands the refrigerant gas expelled from the compressor. The compressor compresses the refrigerant gas repeatedly in such a way that its pressure varies with time describing, for example, a sine wave. On the other hand, the expander is provided with a cylinder with one end closed, a displacer fitted inside the cylinder so as to reciprocate along its axis and divide the space inside it into an expansion chamber, located in the tip-end side thereof, and a working chamber, located in the base-end side thereof, and a resonant spring that elastically supports the reciprocating movement of the displacer.

The working chamber is connected to the compressor, and the pressure of the refrigerant gas from the compressor causes the displacer to reciprocate and thereby expand the refrigerant gas, producing low temperature in a cooling portion at the tip of the cylinder. This type of Stirling refrigerator is generally called a free-piston-type Stirling refrigerator, of which an increasingly widely used type is one having a piston and a displacer fitted coaxially inside a single cylinder.

In general, the piston is driven with a linear motor. By controlling the voltage with which the linear motor is driven, it is possible to control the stroke over which the piston reciprocates and thereby control refrigerating performance. Specifically, reducing the voltage with which the linear motor is driven results in the piston reciprocating over a shorter stroke and thus in lower refrigerating performance; increasing the voltage with which the linear motor is driven results in the piston reciprocating over a longer stroke, and thus in higher refrigerating performance.

To exploit this relationship, as disclosed in Japanese Patent Application Laid-Open No. H2-217757, it is customary to provide one linear motor to drive the piston and another to drive the displacer, and measure the displacements of the piston and the displacer individually in order to control the currents fed to the linear motors in such a way that the neutral positions of the piston and the displacer are kept in fixed positions.

As disclosed in Japanese Patent Application Laid-Open No. H11-304270, it is also conventionally known to find the stroke of the piston on the basis of the power fed to a driver coil and correct for the offset present in the voltage on the basis of the stroke in order to keep the top dead center of the piston in a fixed position and thereby keep the dead volume of the compression space constant.

However, in the conventional Stirling refrigerators described above, when, at the start of operation, the cold-side temperature is close to room temperature, the internal gas pressure has not yet reached that for steady-state operation, and therefore, if the voltage for steady-state operation is applied to the linear motor, there is the danger of the piston and the displacer colliding with each other. The collision occurs in different manners depending on the structure of the Stirling refrigerator in question. Typically, the displacer collides with the closed end of the cylinder, or the resonant spring fitted to the displacer is compressed to the point of being destroyed. Where the piston and the displacer are fitted coaxially, they may go out of phase, colliding with each other.

The collision is likely to occur also when the refrigeration load so varies as to bring the piston and the displacer out of phase, or when there occurs a variation in an external factor (for example, in the supply voltage to the Stirling refrigerator or in the ambient temperature) while the maximum refrigerating performance is being brought out, or owing to an internal factor (for example, an individual variation such as an assembly error or machining error) of the Stirling refrigerator itself. To avoid the danger of collision, the voltage with which the linear motor is driven needs to be set lower than the ideal voltage, and this makes it impossible to bring out the maximum refrigerating performance of the Stirling refrigerator.

While the Stirling refrigerator is operating, if its cooling portion or heat-rejecting portion is cooled or heated abnormally for some cause, or if the temperature around the Stirling refrigerator varies abruptly, there may occur a variation in the vibration of the balance mass fitted to the body of the Stirling refrigerator to suppress its vibration, increasing the amplitude of the vibration. A variation in the vibration of the balance mass results also from an abrupt variation in the gas balance inside the cylinder, or from deviation of the resonance frequencies of internal components from one another. An increase in the vibration of the balance mass leads to an increase in the noise produced by the Stirling refrigerator and to abnormal vibration, even to collision between internal components, resulting in their destruction.

SUMMART OF THE INVENTION

A first aspect of the present invention is a Stirling engine of which destruction is prevented by preventing collision between a piston and a displacer on rapid cooling as at the start of operation and that can operate at its maximum output within the range in which such collision is avoided.

Another aspect of the present invention is a Stirling engine in which collision between internal components as may result from a variation in the voltage of the power supplied from outside or from abnormal vibration of the Stirling engine itself is prevented.

In accordance with these and other aspects of the present invention, a Stirling engine is provided with: a piston that is fitted inside a cylinder filled with a working gas and that is driven to reciprocate by a driving means; a displacer that is fitted coaxially with the piston inside the cylinder and that is driven to reciprocate by the force resulting from reciprocating movement of the piston with a phase difference kept relative thereto; an expansion chamber and a compression chamber that are formed by dividing the space inside the cylinder into two spaces sandwiching the displacer; a first temperature sensing means for sensing the temperature of the expansion chamber; a second temperature sensing means for sensing the temperature of the compression chamber; an input current sensing means for sensing the input current used to drive the piston; and a detecting means for detecting the danger of collision of at least one of the piston and the displacer based on the temperatures sensed by the first and second temperature sensing means and the input current sensed by the input current sensing means.

With this structure, it is possible to detect the danger of collision of the piston and the displacer on the basis of the sensed information on the input current and on the temperatures of the working gas inside the expansion and compression chambers. By measuring the temperatures inside the expansion and compression chambers, it is possible to know variations in the pressures inside the internal spaces, and, on the basis of the information on the input current, it is possible to know the stroke of the piston. This permits the detecting means to judge the danger of collision.

It is preferable that the above-described Stirling engine according to an embodiment of the present invention be further provided with a current controlling means that, when the temperatures and the input current sensed by the temperature sensing means and the input current sensing means are judged to be lower than prescribed levels by the detecting means, increases the input current fed to the driving means, and that, when the temperatures and the input current are judged to be equal to or higher than the prescribed levels, does not increase the input current any further.

With this structure, only when it is judged that there is the danger of collision of the piston and the displacer, increasing of the input current to the linear motor is restricted, and thereby the refrigerator is prevented from destruction. This judgment is made on the basis of information on the current and temperatures at which collision occurs as collected in previously performed test operation. When it is judged that there is no danger of collision, the input current is increased so that, during rapid cooling after the start of operation until the start of steady-state operation, the maximum refrigerating performance is brought out within the range in which collision is avoided.

According to another aspect of the present invention, a Stirling engine is provided with: a piston that is fitted inside a cylinder and that is driven to reciprocate by a driving means; a displacer that is fitted inside the cylinder and that reciprocates with a phase difference kept relative to the piston; a compression chamber formed by partitioning off the space between the piston and the displacer; an expansion chamber formed by partitioning off the space on the side of the displacer opposite to the compression chamber; an inverter power supply circuit for supplying electric power to the driving means; a danger-of-collision detecting means for detecting the danger of collision of the displacer with the piston or with the closed end of the cylinder; and an inverter power supply circuit controlling means for controlling the electric power supplied from the inverter power supply circuit to the driving means based on the information detected by the danger-of-collision detecting means.

In this structure, according to the information detected by the danger-of-collision detecting means, the electric power supplied from the inverter power supply circuit to the driving means is controlled by the inverter power supply circuit controlling means. This prevents collision of the displacer, the piston, and other components and thereby presents destruction of the Stirling engine.

In the above-described Stirling engine according to the second aspect of the present invention, it is preferable that the danger-of-collision detecting means be, for example, a supply voltage detecting means for detecting the voltage of the electric power supplied to the inverter power supply circuit.

In this structure, the voltage of the electric power supplied from an external power source to the inverter power supply circuit is detected by the supply voltage detecting means serving as the danger-of-collision detecting means. This prevents an increase in the amplitude of the piston that results from a variation in the external electric power, and prevents the resulting collision of the piston, displacer, and other components. Thus, the Stirling engine is prevented from destruction.

In the above-described Stirling engine according to the second aspect of the present invention, it is useful to adopt, for example, a comparator as the supply voltage detecting means.

In this structure, a comparator is adopted as the supply voltage detecting means. This makes it easy to monitor the voltage of the supplied electric power.

In the above-described Stirling engine according to the second aspect of the present invention, it is useful to adopt, for example, an analog amplifier as the supply voltage detecting means.

In this structure, an analog amplifier is adopted as the supply voltage detecting means. This makes it easy to monitor the voltage of the supplied electric power.

In the above-described Stirling engine according to the second aspect of the present invention, the danger-of-collision detecting means may be, for example, a combination of a first temperature sensing means for sensing the temperature inside the expansion chamber and a second temperature sensing means for sensing the temperature inside the compression chamber.

In this structure, the temperatures inside the compression and expansion chambers are sensed by the first and second temperature sensing means serving as the danger-of-collision detecting means. This makes it possible to judge the danger of collision of the internal components and thereby prevent collision. Thus, the Stirling engine is prevented from destruction.

In the above-described Stirling engine according to the second aspect of the present invention, the danger-of-collision detecting means may be, for example, a temperature sensing means for sensing the temperature inside a back pressure chamber located on the side of the piston opposite to the compression chamber.

In this structure, when the back pressure chamber is heated abnormally, the temperature inside it is sensed by the temperature sensing means, serving as the danger-of-collision detecting means, for sensing the temperature inside the back pressure chamber. This makes it possible to judge the danger of collision of the internal components and thereby prevent collision. Thus, the Stirling engine is prevented from destruction.

Beneficially, the above-described Stirling engine according to the second aspect of the present invention may be further provided with, for example: a casing for holding the piston in position; a balance mass fitted to the casing for absorbing the vibration of the casing resulting from the reciprocating movement of the piston and the displacer; and a balance mass vibration sensing means for sensing the vibration of the balance mass. Here, the balance mass vibration sensing means serves as the danger-of-collision detecting means.

In this structure, abnormal vibration of the casing is detected by the balance mass vibration sensing means, serving as the danger-of-collision detecting means, for sensing the vibration of the balance mass fitted to the casing. This makes it possible to prevent collision of the internal components.

In the above-described Stirling engine according to the second aspect of the present invention, the balance mass vibration sensing means may be, for example, an optical sensor that senses the amplitude of the balance mass relative to the central position thereof.

In this structure, an optical sensor is used as the balance mass vibration sensing means. This makes it easy to monitor the vibration of the balance mass.

In the above-described Stirling engine according to the second aspect of the present invention, the balance mass vibration sensing means may be, for example, a touch sensor that senses the position of the balance mass by making contact therewith.

In this structure, a touch sensor is used as the balance mass vibration sensing means. This makes it easy to monitor the vibration of the balance mass.

According to another aspect of the present invention, a free-piston-type Stirling engine including a piston and a displacer that reciprocate inside a cylinder filled with a working gas and a linear motor that drives the piston to reciprocate is further provided with: a stroke detecting means for detecting the stroke of the piston; and a controlling means for comparing the stroke detected by the stroke detecting means with a target stroke and controlling the linear motor in such a way that the stroke of the piston is kept equal to the target stroke.

In this structure, as the linear motor is driven, the piston and the displacer reciprocate with a predetermined phase difference kept between them and thereby compress and expand the working medium, achieving a refrigeration cycle. The stroke detecting means detects the stroke of the piston, and the controlling means makes the stroke of the piston equal to the target strode. The target stroke is set, for example, by being calculated based on a functional equation with respect to the cold-side and hot-side temperatures of the Stirling engine.

According to another aspect of the present invention, a free-piston-type Stirling engine including a piston and a displacer that reciprocate inside a cylinder filled with a working gas and a linear motor that drives the piston to reciprocate is further provided with: a controlling means for storing, in the form of an operation table, different target strokes of the piston corresponding to different operation conditions of the Stirling engine and controlling the linear motor according to the operation table.

In this structure, as the linear motor is driven, the piston and the displacer reciprocate with a predetermined phase difference kept between them and thereby compress and expand the working medium, achieving a refrigeration cycle. The controlling means stores, in the form of an operation table, different target strokes of the piston corresponding to different operation conditions of the Stirling engine, and makes the stroke of the piston equal to the target stroke according to the operation table.

According to embodiments of the present invention, the stroke detecting means may detect the stroke by finding the back electromotive force Vg based on the functional equation $$Vg=Vt-RI\cos\theta-L\sin\theta\cdot dI/dt$$

from the voltage Vt applied to the linear motor, the current I consumed by the linear motor, the inductance L of the linear motor, the resistance component R of the linear motor, and the phase difference θ between the applied voltage Vt and the consumed current I, and then calculating the stroke Xp by exploiting the fact that the back electromotive force Vg is a function of the stroke Xp of the piston.

In particular, when the load on the Stirling engine is light, the phase difference θ can be approximated as $\theta\approx 0$ and the resistance component R of the linear motor can be regarded as a function of the phase difference θ. Thus, the functional equation may be simplified to $$Vg=Vt-R(\theta)I.$$

In this case, the phase difference θ may be calculated as a function of the cold-side and hot-side temperatures of the Stirling engine.

According to one embodiment of the present invention, the operation table may be a one-dimensional table taking as a variable the lapse of time from the starting of operation of the Stirling engine, or a two-dimensional table taking as variables the cold-side and hot-side temperatures of the Stirling engine.

According to one embodiment of the present invention, a collision detecting means for detecting collision of the piston with the displacer may be additionally provided so that, when the collision detecting means detects collision, the controlling means lowers, by a predetermined value, the voltage with which the linear motor is driven.

When the Stirling engine has just started operating or is operating with high refrigerating performance, the piston and the displacer are likely to come close together rapidly and collide with each other. However, in this structure, even if collision occurs, it is possible to detect it and instantaneously avoid danger. In this case, the predetermined value by which the controlling means lowers the voltage with which the linear motor is driven is set by being calculated based on a functional equation with respect to the cold-side and hot-side temperatures of the Stirling engine.

The collision detecting means detects collision by detecting that the current consumed by the linear motor exceeds a predetermined value when the voltage applied to the linear motor is raised by a predetermined value, or by detecting that a variation in the current consumed by the linear motor exceeds a predetermined level when the voltage applied to the linear motor is kept constant.

The control performed when collision is detected is ended when a predetermined length of time elapses after the detection of collision. Thereafter, control of the linear motor based on the target stroke is restored.

According to embodiments of the present invention, different sets of data with which to correct the target stroke of the piston corresponding to different intervals between the piston and the displacer may be stored in a correction data table so that the target stroke is corrected according to the correction data table based on the interval observed in each refrigerator. With this structure, even though the target stroke differs from one refrigerator to another owing to assembly errors and machining errors inevitable in the Stirling engine, the target stroke of each refrigerator can be set with a correction made by entering the interval of that particular refrigerator according to the correction data stored for correcting the target stroke.

According to an embodiment of the present invention, different sets of correction data with which to correct the target stroke of the piston corresponding to different input voltages to the Stirling engine or different currents consumed by the linear motor may be stored so that the target stroke is corrected according to the correction data based on variation in the input voltage or the consumed current. With this structure, even though the stroke of the piston varies with variation in the input voltage to the Stirling engine or in the power consumption of the linear motor, the piston can be driven with a target stroke corrected by making the power supply portion generate a voltage corresponding to the corrected target stroke and driving the linear motor with this voltage.

BRIEF DESCRIPTION OF DRAWINGS

FIG. 8 is a schematic diagram illustrating the lookup table used to control the operation of the Stirling refrigerator of the third embodiment of the invention.

DETAILED DESCRIPTION

Hereinafter, embodiments of the present invention will be described with reference to the drawings.

Figure 1:
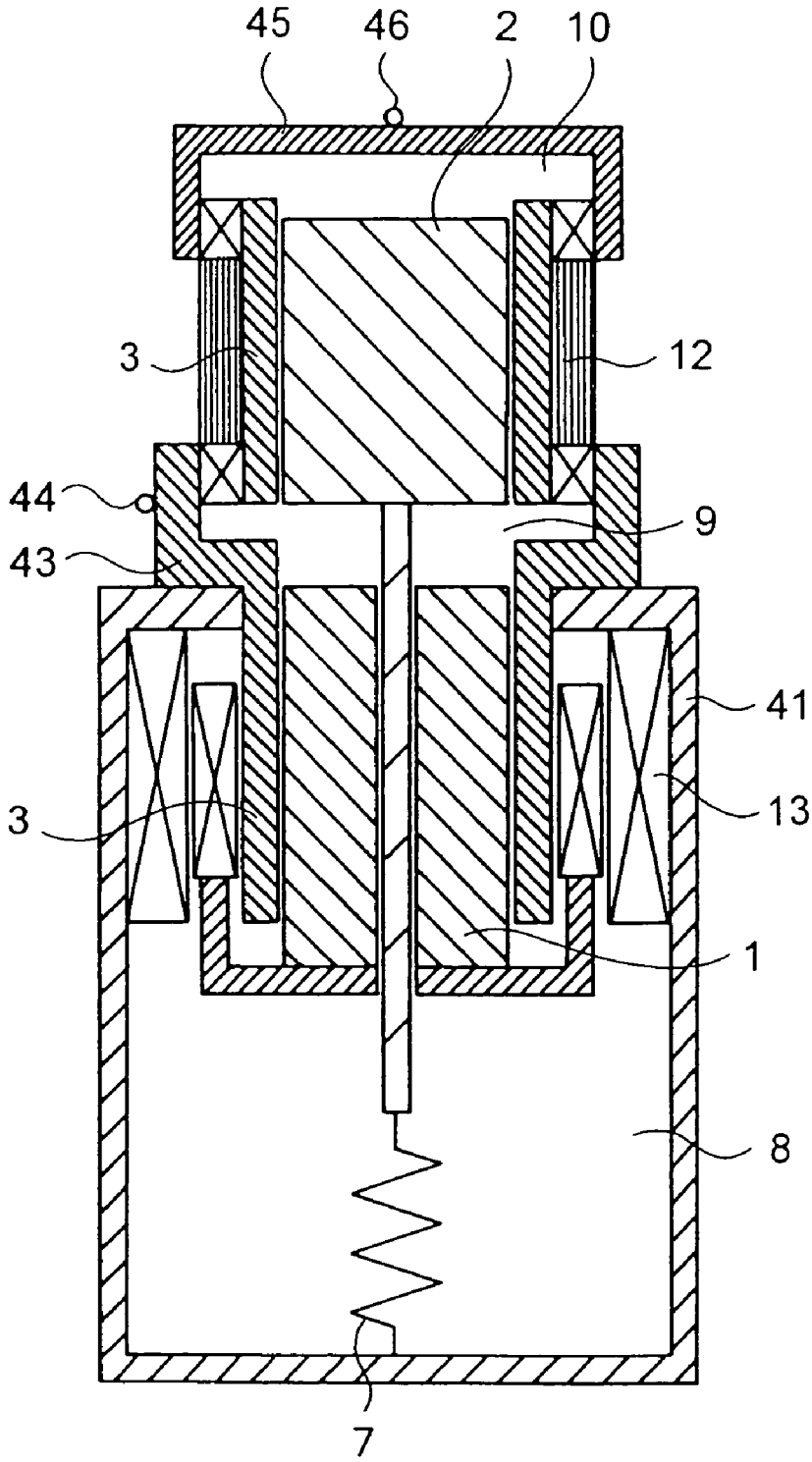
FIG. 1 is a sectional view of the Stirling refrigerator of a first embodiment of the invention.

FIG. 1 is a sectional view showing the structure of the free-piston-type Stirling refrigerator of a first embodiment of the invention. First, the structure of the Stirling refrigerator of this embodiment will be described. As shown in FIG. 1, the body of the Stirling refrigerator is provided with a cylinder 3 having a cylindrical space inside, and a piston 1 and a displacer 2 are coaxially fitted in the cylindrical space. The working space inside the cylinder 3 is filled with a working gas such as helium gas, hydrogen gas, or nitrogen gas.

The working space is partitioned by the displacer 2 into two spaces, namely a compression space (compression chamber) 9, located closer to the piston 1, and an expansion space (expansion chamber) 10, located closer to the closed end of the cylinder. A regenerator 12 is provided in the path that connects together the compression space 9 and the expansion space 10 outside the cylinder 3, and the regenerator 12 is so structured as to permit the working gas to pass therethrough.

A heat-rejecting portion 43 for rejecting the heat generated in the compression space 9 to outside is so formed as to enclose the compression space 9, and a cooling portion 45 for transmitting the cold temperature produced in the expansion space 10 to outside is so formed as to enclose the expansion space 10. The heat-rejecting portion 43 and the cooling portion 45 are fitted with temperature sensors 44 and 46, respectively, for sensing their temperatures. The displacer 2 is connected to a casing 41 of the body of the refrigerator by a resonant spring 7.

The piston 1 is driven by a linear motor 13. The linear motor 13 is fed with electric power by a power supply driving circuit 48, and the current input thereto is monitored by a refrigerator input current sensing portion 52 (See FIG. 2).

Next, the principle of how the Stirling refrigerator of this embodiment operates will be described. This Stirling refrigerator achieves a refrigerating effect by exploiting the so-called reverse Stirling cycle. The piston 1 is driven to move so as to describe a sine curve by the linear motor 13. As the piston 1 moves, the pressure of the working gas inside the compression space 9 varies so as to describe a sine curve.

The compressed working gas releases compression heat in the heat-rejecting portion 43, then passes through the regenerator 12, where the working gas is pre-cooled, and then flows into the expansion space 10.

In steady-state operation, the displacer 2 moves so as to describe a sine curve with the same period as but with a predetermined phase difference relative to the piston 1. Their phase difference and amplitude are determined by the spring constant of the resonant spring 7, the constantly changing pressure difference between the compression space 9 and the expansion space 10, the mass of the displacer 2, the operating frequency, and other factors. The optimal phase difference is generally believed to be around 90° C.

The working gas that has flowed into the expansion space 10 is expanded by the sinusoidal movement of the displacer 2, and this greatly lowers the temperature inside the expansion space 10. The cryogenic low temperature so produced is transmitted through the cooling portion 45 to the interior of the refrigerator to achieve a desired refrigerating effect.

Figure 2:
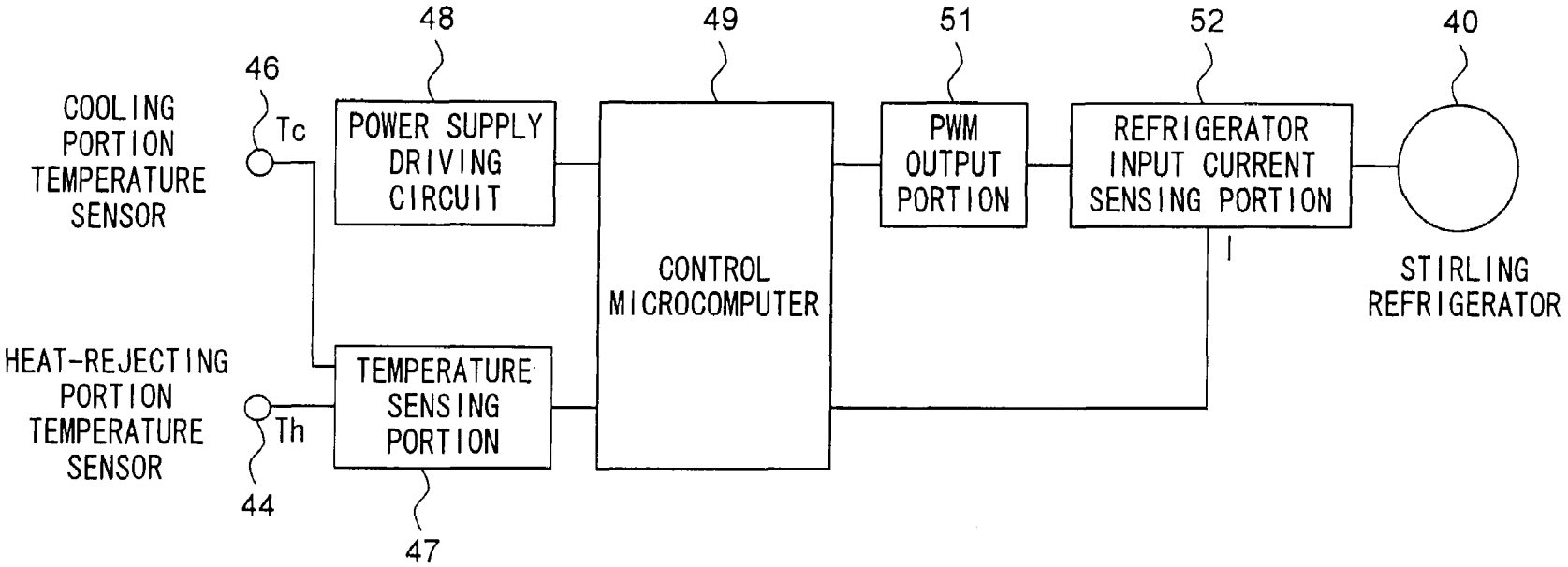
FIG. 2 is a block diagram of the control circuit of the Stirling refrigerator of the first embodiment of the invention.

Next, the control circuit of the Stirling refrigerator of this embodiment will be described. FIG. 2 is a block diagram showing the configuration of the control circuit of the Stirling refrigerator described above. As shown in this figure, the temperature information (Th, Tc) sensed by the temperature sensors 44 and 46 fitted to the heat-rejecting portion 43 and the cooling portion 45 is fed through a temperature sensing portion 47 to a control microcomputer 49. Here, Th represents the temperature in the heat-rejecting portion 43, and Tc represents the temperature in the cooling portion 45. The input current information (I) sensed by the refrigerator input current sensing portion 52 is also fed to the control microcomputer 49.

The control microcomputer 49 judges whether the individual signals fed thereto mentioned above are within previously stored ranges of standard values or not, produces a control signal for controlling the Stirling refrigerator, and feeds the control signal to a PWM (pulse-width modulation) output portion 51. According to this control signal, the PWM output portion 51 controls the Stirling refrigerator by pulse-width modulation.

Figure 3:
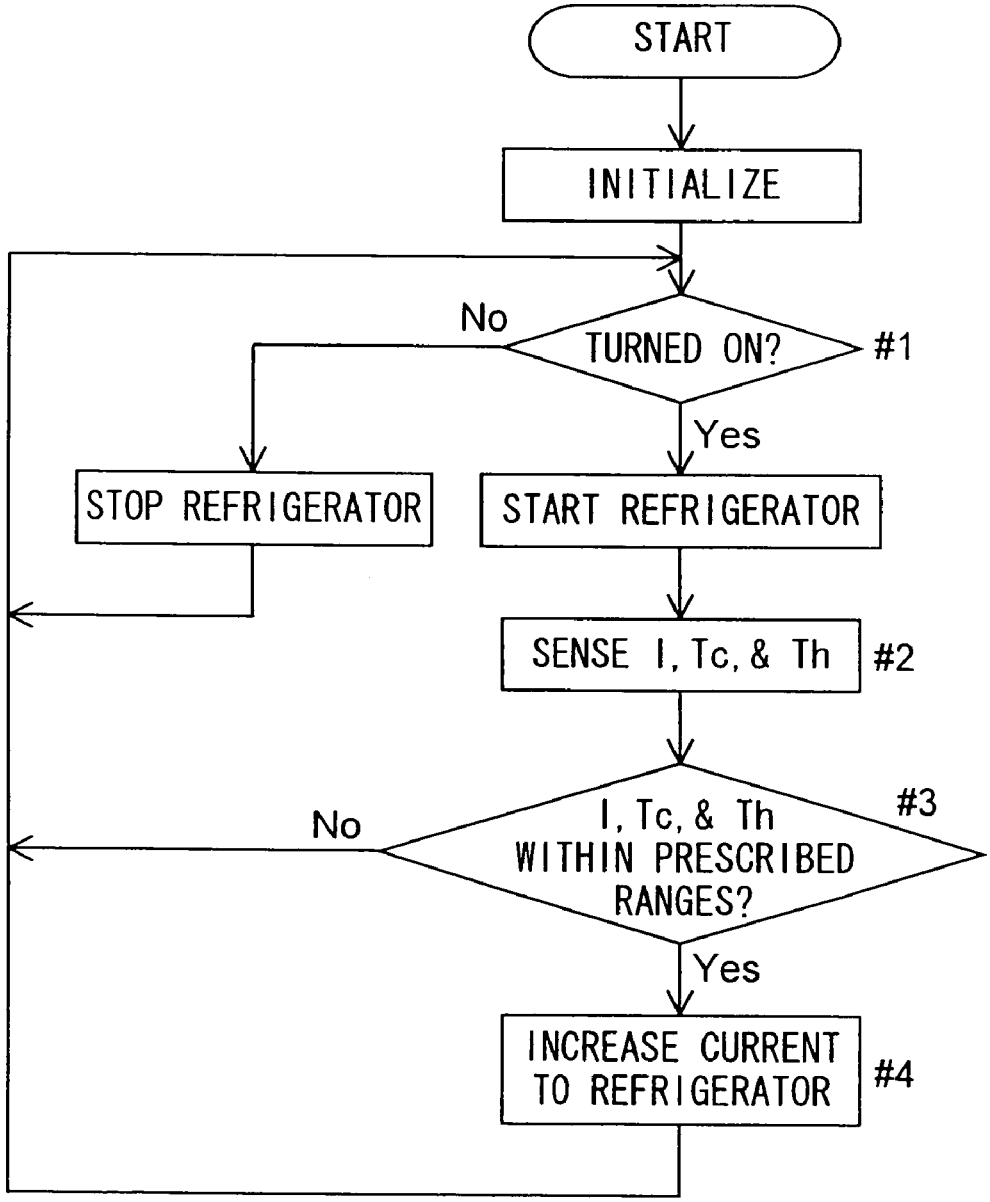
FIG. 3 is a flow chart of the control operation of the Stirling refrigerator of the first embodiment of the invention.

FIG. 3 is a flow chart of the control operation in this embodiment. As shown in the figure, when, in step #1, the Stirling refrigerator starts operating, then, in step #2, the temperature information (Th, Tc) and the input current information (I) is sensed.

Subsequently, in step #3, whether the information sensed is within prescribed ranges of standard values or not is checked and thereby the danger of collision is judged. This is possible because, by analyzing the sensed information, it is possible to know the piston stroke and thereby detect the danger of collision. Here, the prescribed ranges of standard values are set on the basis of information collected at the time of collision in test operation (for example, by a method relying on a table lookup).

If, in step #3, it is judged that there is no danger of collision, then, in step #4, the input current is increased by a predetermined value. Here, to avoid an excessive increase in the piston stroke, input the current should be increased in small increments. By contrast, if, in step #3, it is judged that there is danger of collision, then the control microcomputer 49 so controls that the input current fed to the refrigerator is not increased any further.

As described above, the current fed to the linear motor and the temperatures inside the compression and expansion spaces are monitored, and the sensed values are compared with standard values previously obtained in test operation to judge the danger of collision of the piston and the displacer. According to the result of this judgment, the Stirling refrigerator is operated. This makes it possible to prevent collision between the internal components such as the piston and the displacer, and to achieve operation with the maximum output while avoiding collision between the internal components such as the piston and the displacer.

Figure 4:
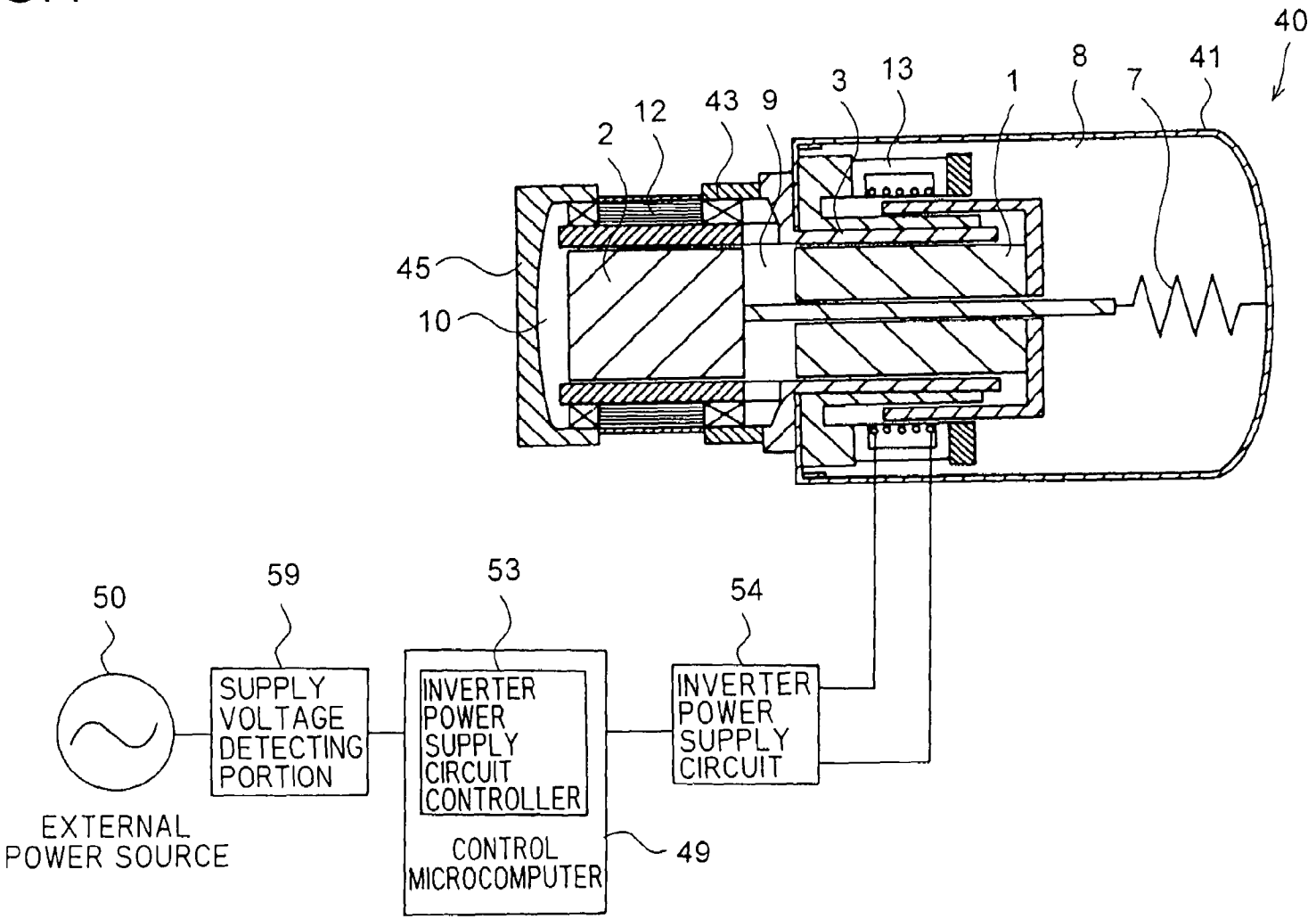
FIG. 4 is a block diagram of the Stirling refrigerator of a second embodiment of the invention.

FIG. 4 is a block diagram of the control circuit of the Stirling refrigerator of a second embodiment of the invention. It is to be noted that, here, such components as are found also in the first embodiment described above are identified with the same reference numerals, and their explanations will not be repeated.

As shown in FIG. 4, the voltage of the electric power supplied from an external power source 50 is detected by a supply voltage detecting portion 59, and this voltage information is fed to the control microcomputer 49. The control microcomputer 49 processes the voltage information fed thereto, and feeds a control signal through an inverter power supply circuit controller 53 to an inverter power supply circuit 54 so that the voltage of the electric power supplied to the linear motor 13 is kept at a proper value. According to this control signal, the inverter power supply circuit 54 makes the voltage of the electric power it feeds to the linear motor 13 equal to the proper voltage. Here, the control signal that is fed from the inverter power supply circuit controller 53 to the inverter power supply circuit 54 is a signal that achieves pulse-width modulation in the PWM control performed in the inverter power supply circuit.

Figure 5:
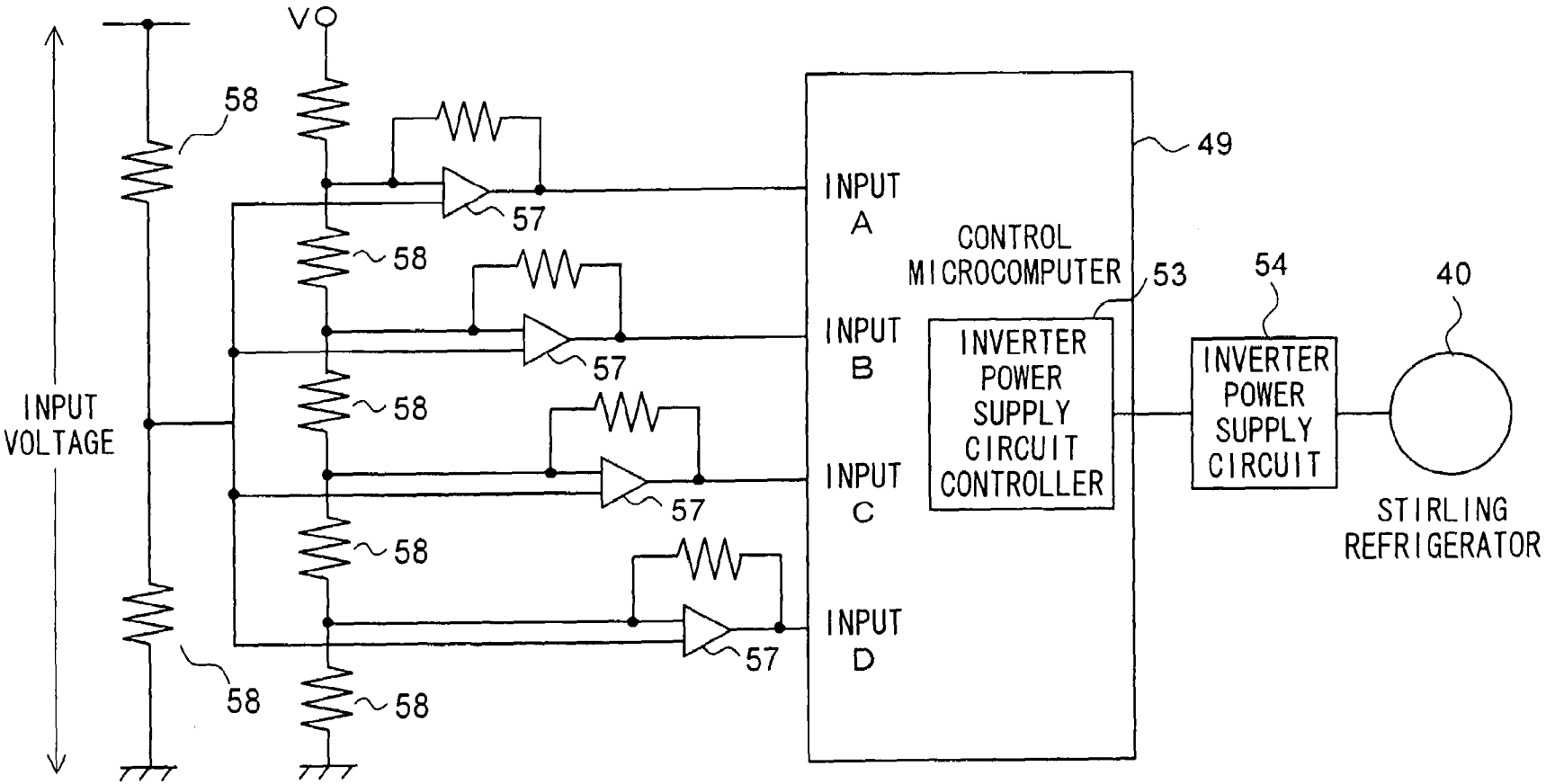
FIG. 5 is a block diagram of the control circuit of the Stirling refrigerator of the second embodiment of the invention, in a case where comparators are used in the supply power detecting portion.

FIG. 5 shows an example of the circuit of the supply voltage detecting portion 59, in a case where comparators are adopted. To detect the voltage of the electric power supplied from the external power source, the voltage of the supplied electric power is divided with resistors, and the variation of the voltage is fed to the control microcomputer 49 through comparators 57. Here, depending on the voltage of the supplied electric power, the control microcomputer 49 receives inputs A, B, C, and D on a stepwise basis. The signals that are fed to the control microcomputer 49 determine the output signal thereof with reference to threshold voltages, for example, on the basis of Table 1 shown below, so that a properly pulse-width-modulated output signal is fed to the inverter power supply circuit 54.

TABLE 1

| Microcomputer Input | | | | Threshold | |
|---|---|---|---|---|---|
| A | B | C | D | Voltage (V) | Microcomputer Output |
| 0 | 0 | 0 | 0 | V ≦ 90 | Stop output |
| 1 | 0 | 0 | 0 | 90 < V < 95 | Output pulses wider than standard width |
| 1 | 1 | 0 | 0 | 95 ≦ V < 105 | Output pulses with standard width |
| 1 | 1 | 1 | 0 | 105 ≦ V < 110 | Output pulses narrower than standard width |
| 1 | 1 | 1 | 1 | 110 ≦ V | Stop output |

With reference to Table 1 shown above, for example, when the inputs A/B/C/D to the control microcomputer 49 are 0/0/0/0, the voltage of the supplied electric power is judged to be equal to or lower than 90 V, and the output to the inverter power supply circuit 54 is stopped to stop the operation of the Stirling refrigerator 40. When the inputs to the control microcomputer 49 are 1/1/1/1/, the voltage of the supplied electric power is judged to be equal to or higher than 110 V, and the output to the inverter power supply circuit 54 is likewise stopped to stop the operation of the Stirling refrigerator 40. When the inputs to the control microcomputer 49 are 1/1/0/0, the voltage of the supplied electric power is judged to be equal to or higher than 95 V but lower than 105 V, and a pulse signal with a standard width is output. In other cases than those mentioned above, according to the voltage information, pulses with a standard with is pulse-width-modulated so that the proper voltage is restored.

Figure 6:
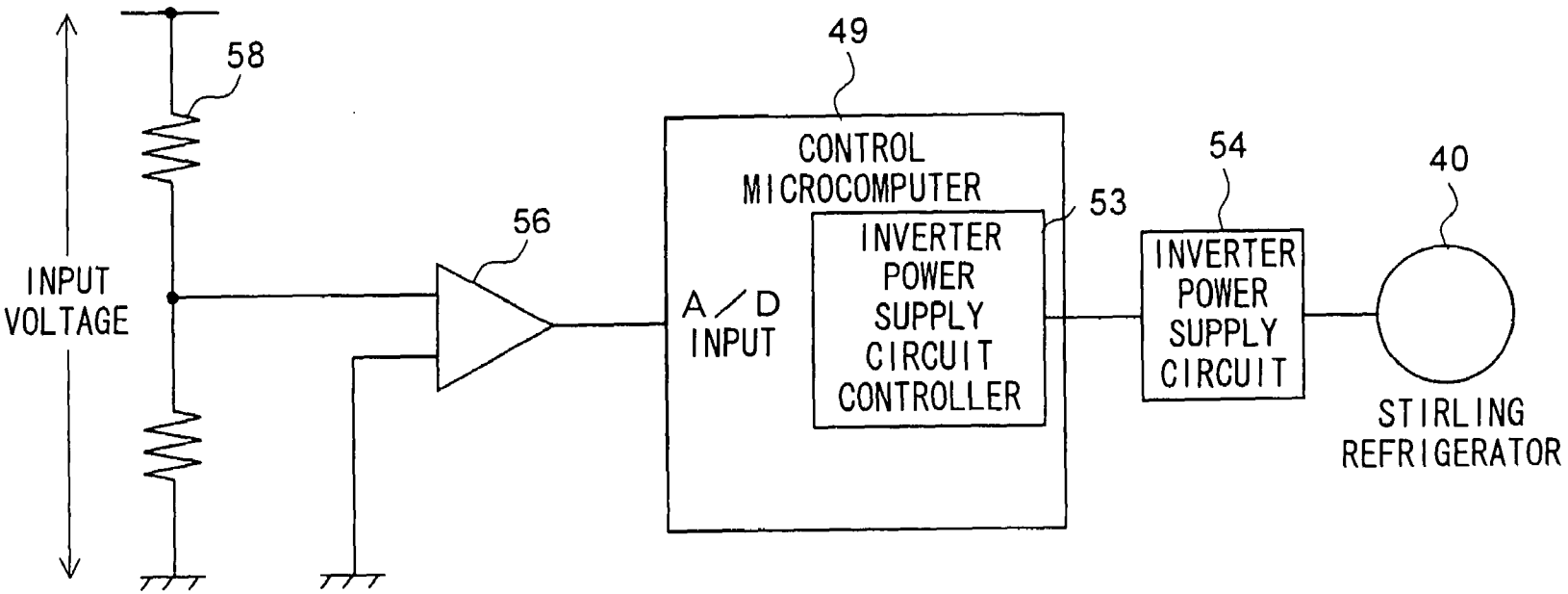
FIG. 6 is a block diagram of the control circuit of the Stirling refrigerator of the second embodiment of the invention, in a case where an analog amplifier is used in the supply power detecting portion.

FIG. 6 shows an example of the circuit of the supply voltage detecting portion 59, in a case where an analog amplifier is adopted. In this case, the voltage of the supplied electric power is converted into 0 to 5 V by an analog amplifier 56, and this converted voltage is fed to the control microcomputer 49. The voltage signal fed to the control microcomputer 49 is operationally processed, and is then fed to the inverter power supply circuit 54. When the voltage of the supplied electric power is judged to be abnormal, the output to the inverter power supply circuit 54 is stopped to stop the operation of the Stirling refrigerator 40.

As described above, the variation of the voltage of the supplied electric power is detected by the supply voltage detecting means, and, according to this information, the control microcomputer performs pulse-width modulation so that the voltage is kept at a proper voltage. By the use of the output voltage thus produced, the inverter power supply circuit adjusts the voltage of the electric power fed to the Stirling refrigerator. This ensures the optimum operation condition. When the voltage of the supplied electric power is judged to be abnormal, the supply of electric power to the Stirling refrigerator is stopped. This makes it possible to prevent the Stirling refrigerator from being destroyed as a result of collision between the internal components.

Figure 7:
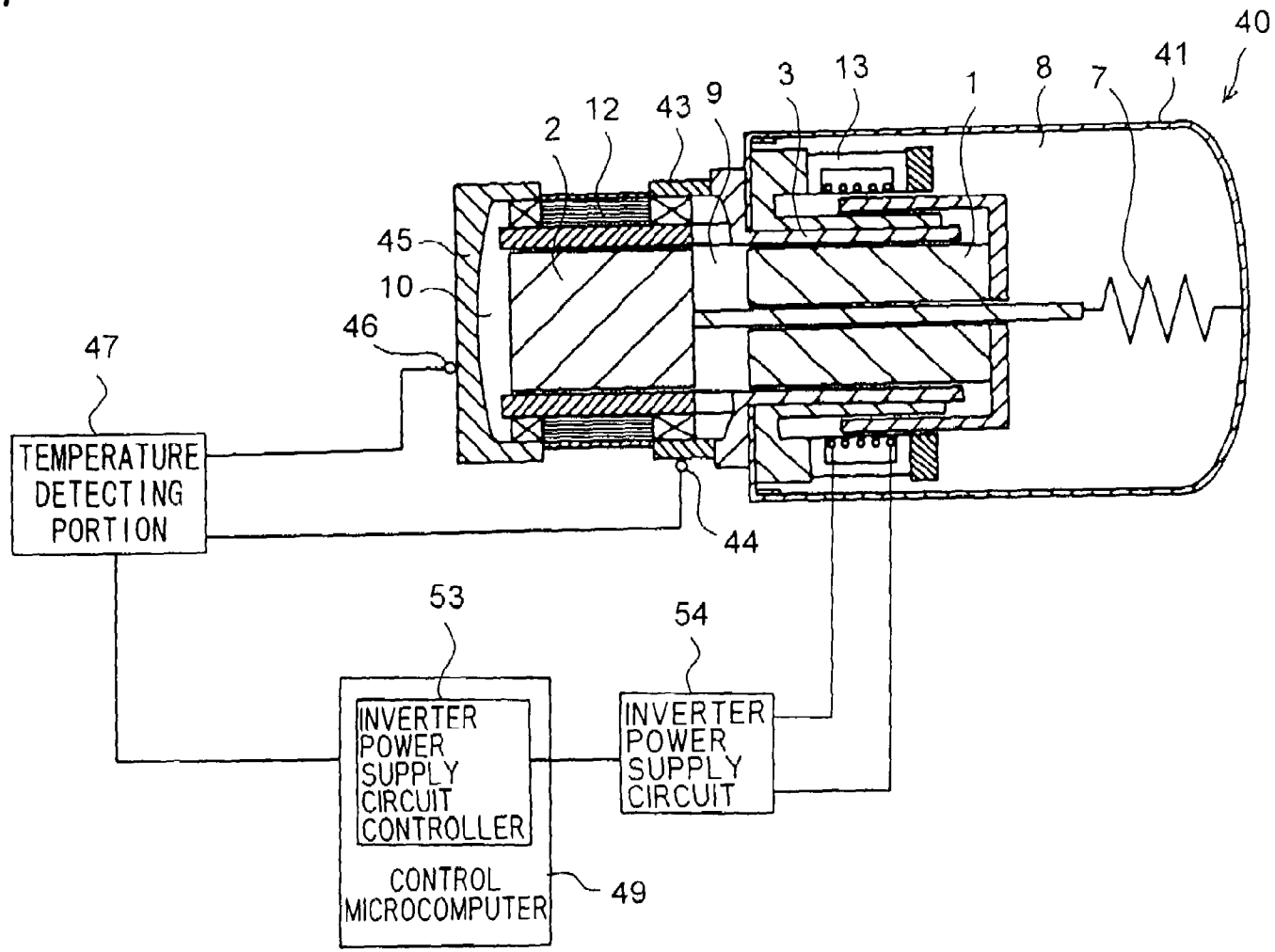
FIG. 7 is a block diagram of the Stirling refrigerator of a third embodiment of the invention.

FIG. 7 is a block diagram of the Stirling refrigerator of a third embodiment of the invention. It is to be noted that, here, such components as are found also in the first and second embodiments described above are identified with the same reference numerals, and their explanations will not be repeated.

In the Stirling refrigerator of this embodiment, as in the first embodiment described earlier, temperature sensors 44 and 46 are fitted to the heat-rejecting portion 43 and the cooling portion 45. The temperature information sensed by the temperature sensors 44 and 46 is fed through a temperature sensing portion 47 to the control microcomputer 49. The control microcomputer 49 then determines its output signal by referring to a lookup table (see FIG. 8) previously stored therein, and feeds the output signal to the inverter power supply circuit 54. The lookup table is created on the basis of the information obtained by collecting data in abnormally heated and cooled states, in which collision of the internal components of the Stirling refrigerator occurs, in test operation.

Figure 9:
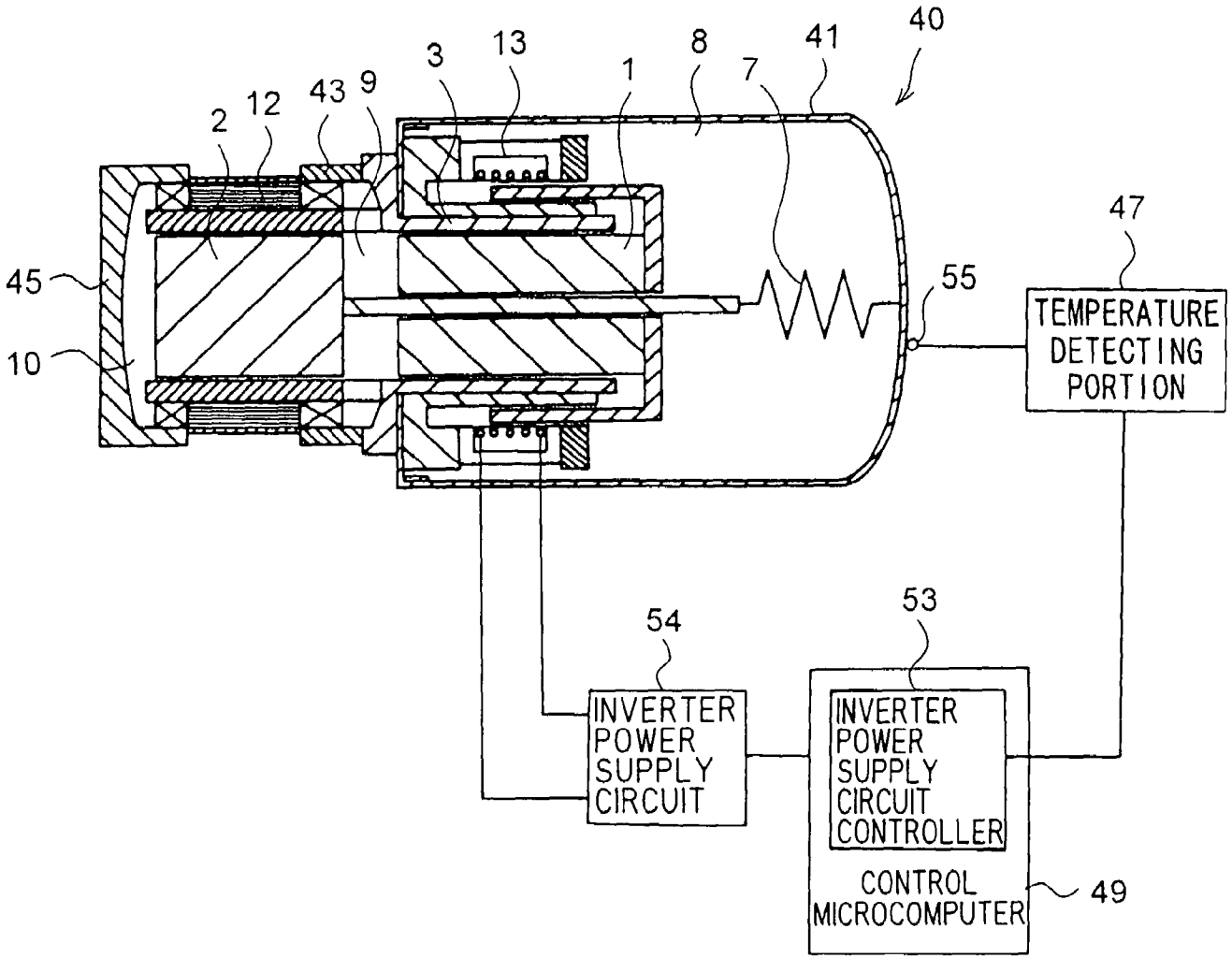
FIG. 9 is a block diagram showing another example of the third embodiment of the invention.

As shown in FIG. 9, which shows another example, it is also possible to detect an abnormality by sensing the temperature inside a bounce space (back pressure chamber) 8 located on the side of the piston 1 opposite to the compression space 9. In this case, by fitting a temperature sensor 55 to the body casing 9 forming the bounce space 8, the temperature inside the bounce space 8 is indirectly monitored. The reason that an abnormality can be detected by monitoring the temperature of the bounce space 8 is that, since the compression space 9 and the bounce space 8 communicate with each other, when the compression space 9 is heated abnormally, the bounce space 8 is also heated abnormally.

Figure 10:
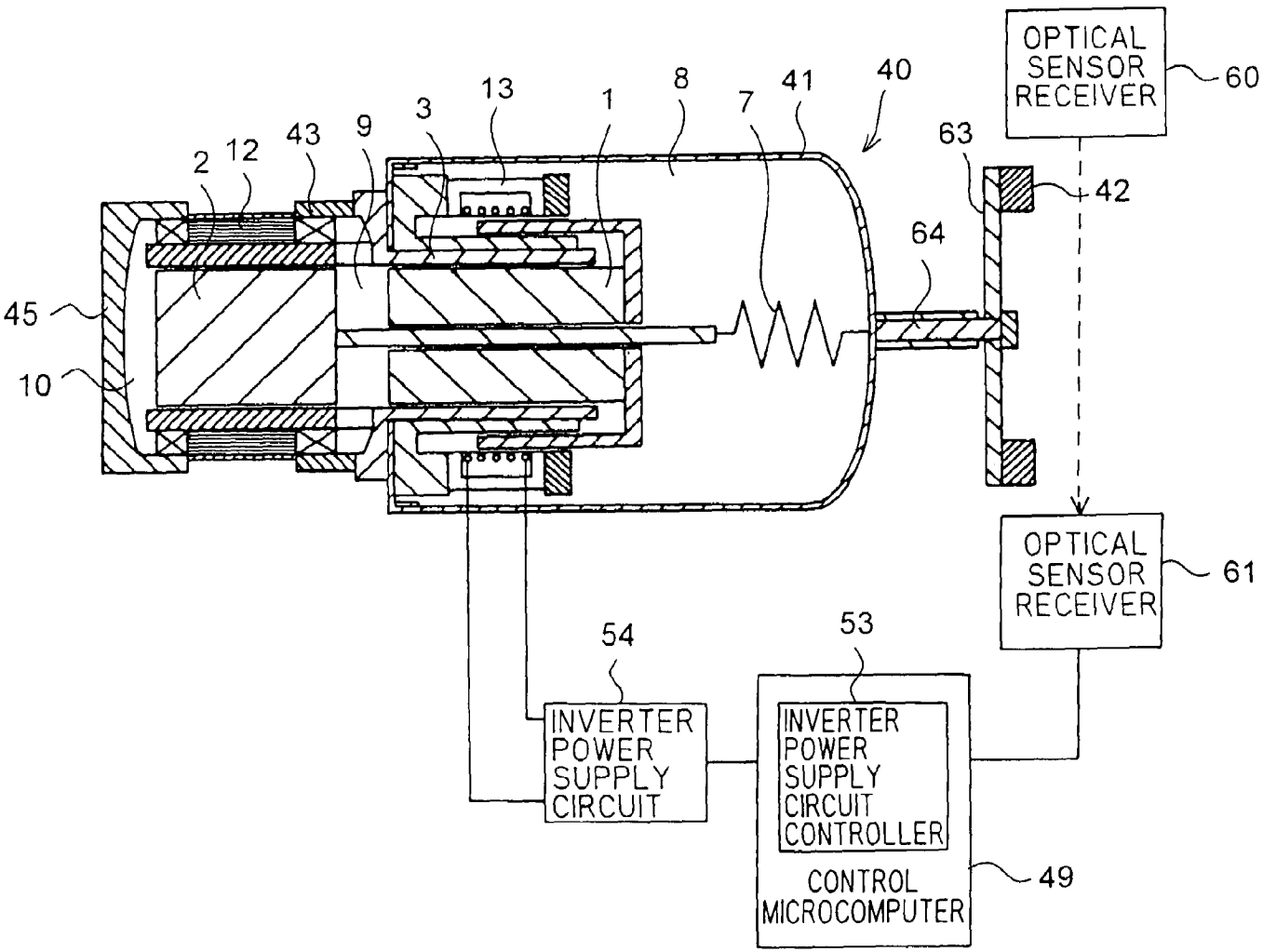
FIG. 10 is a block diagram of the Stirling refrigerator of a fourth embodiment of the invention.

FIG. 10 is a block diagram of the Stirling refrigerator of a fourth embodiment of the invention. In the Stirling refrigerator of this embodiment, abnormal vibration of a balance mass is sensed in order to detect the danger of collision of the internal components such as the piston and the displacer and thereby prevent such collision. It is to be noted that, here, such components as are found also in the first to third embodiments described above are identified with the same reference numerals, and their explanations will not be repeated.

As shown in the figure, to the body casing 41 of the Stirling refrigerator 40, a balance mass 42 is connected through a mass spring 63 and a mass spring support member 64. The balance mass 42 is fitted to suppress the vibration of the body of the Stirling refrigerator 40. When the Stirling refrigerator 40 is vibrating abnormally, the balance mass 42 also vibrates abnormally. Thus, by monitoring the amplitude of the balance mass 42, it is possible to detect an abnormality of the Stirling refrigerator.

The range of the amplitude of the balance mass 42 as observed when the Stirling refrigerator 40 is operating normally is previously measured, and the amplitude of the balance mass 42 is monitored with an optical sensor 60 and 61 disposed in the vicinity of the balance mass 42. In the event of abnormal vibration, the rays emitted from the transmitter 60 of the optical sensor is intercepted by the balance mass and thus does not reach the receiver 61 of the optical sensor. In this case, the voltage signal fed from the optical sensor receiver 61 to the control microcomputer 49 reduces. On detecting this, the control microcomputer 49 immediately stops the output to the inverter power supply circuit 54 to stop the operation of the Stirling refrigerator 40.

Figure 11:
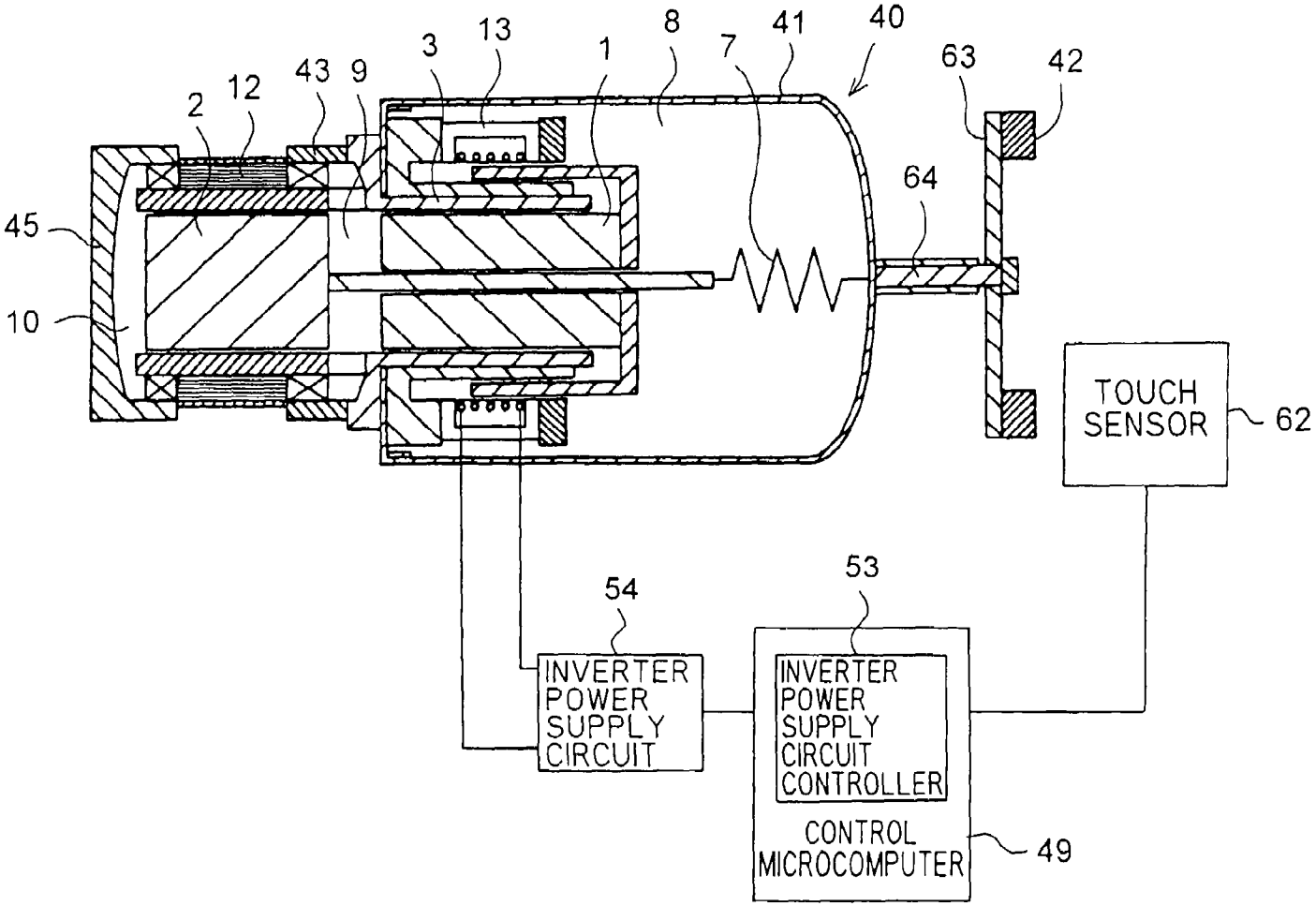
FIG. 11 is a block diagram showing another example of the Stirling refrigerator of the fourth embodiment of the invention.

In this way, by detecting abnormal vibration of the Stirling refrigerator, it is possible to prevent collision between the internal components and thereby prevent destruction of the Stirling refrigerator. Instead of the optical sensor, it is also possible to dispose a touch sensor 62 as shown in FIG. 11 in the vicinity of the balance mass 42 so that, when the balance mass 42 vibrates abnormally, it makes contact with the touch sensor 62, permitting it to detect abnormal vibration.

All the embodiments described thus far deal with cases in which the present invention is applied to a Stirling refrigerator having a piston and a displacer fitted coaxially. It is also possible, however, to apply the present invention to Stirling refrigerators having a compressor and an expander provided separately.

All the embodiments described thus far deal with examples in which the displacer is connected to the body casing of the Stirling refrigerator by a resonant coil spring. It is possible, however, to apply the present invention to a Stirling refrigerator structured in any other manner, for example one employing a gas spring or plate spring instead of a resonant coil spring.

The first and third embodiments described above deal with cases in which the temperature sensors for sensing the temperatures of the compression and expansion spaces are fitted thereto so as to directly sense those temperatures. It is also possible, however, to place the temperature sensors inside the compression and expansion spaces to directly measure the temperatures of the working gas therein.

Figure 12:
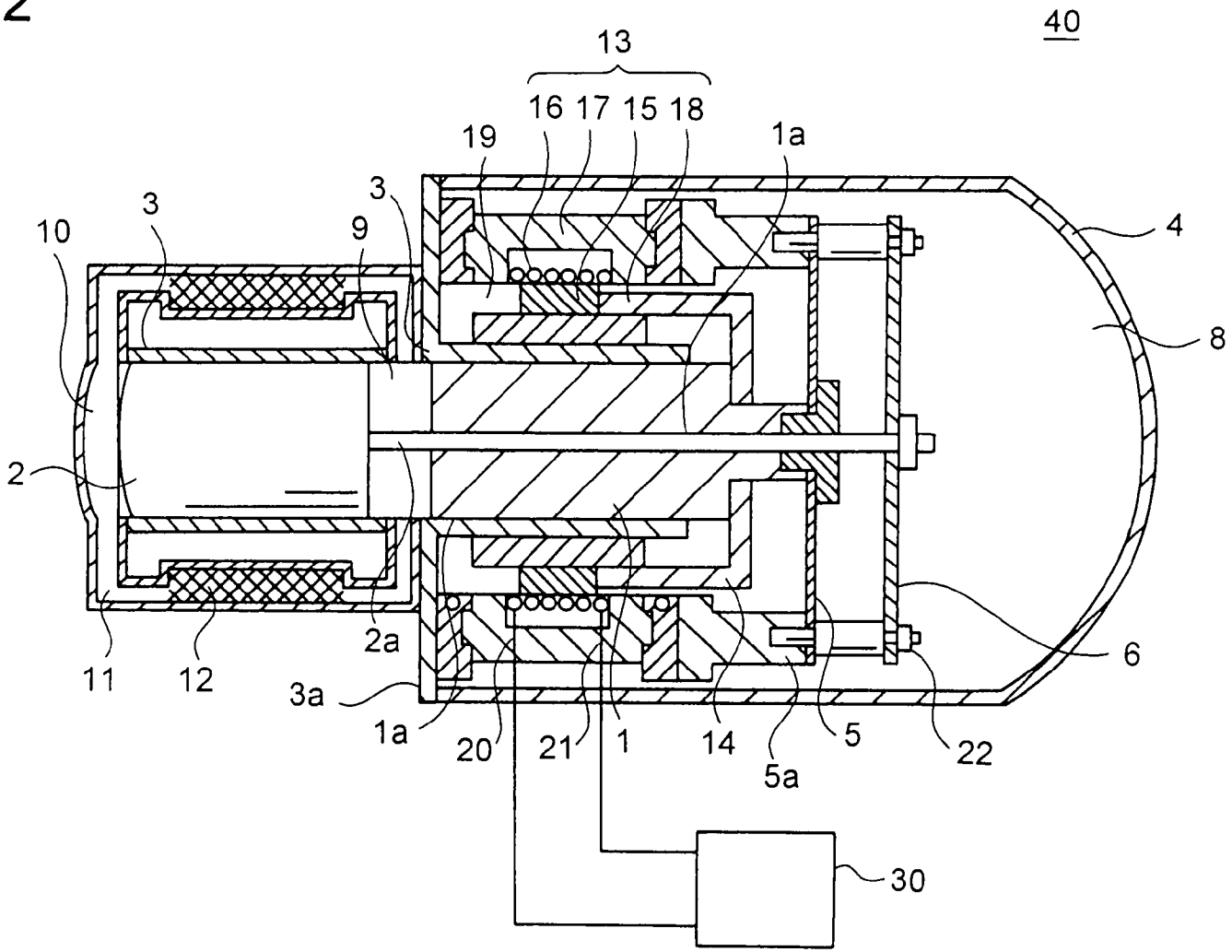
FIG. 12 is a sectional view of the Stirling refrigerator of a fifth embodiment of the invention.

FIG. 12 is a sectional view showing the Stirling refrigerator of a fifth embodiment of the invention. The Stirling refrigerator 40 has a piston 1 and a displacer 2, both column-shaped, fitted inside a substantially cylindrical cylinder 3 having the space inside it divided in the direction of its axis. The piston 1 and the displacer 2 are arranged coaxially with an expansion space 9 (hereinafter also referred to as the "warm section") interposed in between.

At the closed end of the cylinder 3, between it and the displacer 2, there is formed an expansion space 10 (hereinafter also referred to as the "cold section"). The compression space 9 and the expansion space 10 communicate with each other through a medium flow passage 11 through which a working medium such as helium passes. In the medium flow passage 11, there is arranged a regenerator 12 that accumulates the heat of the working medium and that then supplies the accumulated heat back to the working medium. In about the middle of the cylinder 3, there is formed a shoulder portion 3*a* so as to protrude radially therefrom. To the shoulder portion 3*a* is fitted a dome-shaped pressure-resistant vessel 4, of which the interior is kept air-tight to form a bounce space 8.

The piston 1 is, at its rear end, secured to a piston support spring 5, and the displacer 2 is secured to a displacer support spring 6 through a rod 2*a* penetrating through a center hole l*a* of the piston 2. The piston support spring 5 and the displacer support spring 6 are coupled together with screws 22. As will be described later, as the piston 1 reciprocates, the displacer 2, by its own inertial force, reciprocates with a predetermined phase difference kept relative to the piston 2.

Inside the bounce space 8, an inner yoke 18 is fitted around the cylinder 3. Further around the inner yoke 18 is disposed an outer yoke 17 with a gap 19 secured in between. A driving coil 16 is housed in the outer yoke 17, and a ring-shaped permanent magnet 15 is movably disposed in the gap 19. The permanent magnet 15 is secured to the piston 1 through a cup-shaped sleeve 14. In this way, a linear motor 13 is formed that, when a voltage is applied to the driving coil 16, moves the piston 1 along its axis.

To the driving coil 16, there are connected leads 20 and 21, which penetrate the wall surface of the pressure-resistant vessel 4 through hermetically sealed terminals 37 (see FIG. 13) and are connected to a control box 30. The control box 30 supplies the electric power with which the linear motor 13 is driven.

In the Stirling refrigerator 40 structured as described above, when the piston 1 is driven to reciprocate by the linear motor 13, the displacer 2, by its own inertial force, reciprocates with a predetermined phase difference kept relative to the piston 1 This causes the working medium to move between the compression space 9 and the expansion space 10 to form the reverse Stirling cycle. Specifically, the heat generated in the compression space 9, i.e., the hot side, as a result of the working medium being compressed is rejected through the medium flow passage 11 to the atmosphere, and the working medium then, while accumulating heat in the regenerator 12, moves to the expansion space 10.

The working medium cooled by the regenerator 12 is then further cooled in the expansion space 10, i.e., the cold side, by being expanded. The working medium is then, while moving through the medium flow passage 11 to the compression space 9, heated by the heat accumulated in the regenerator 12. This sequence of events is repeated, so that the expansion space 10 (cold section) is refrigerated.

Figure 13:
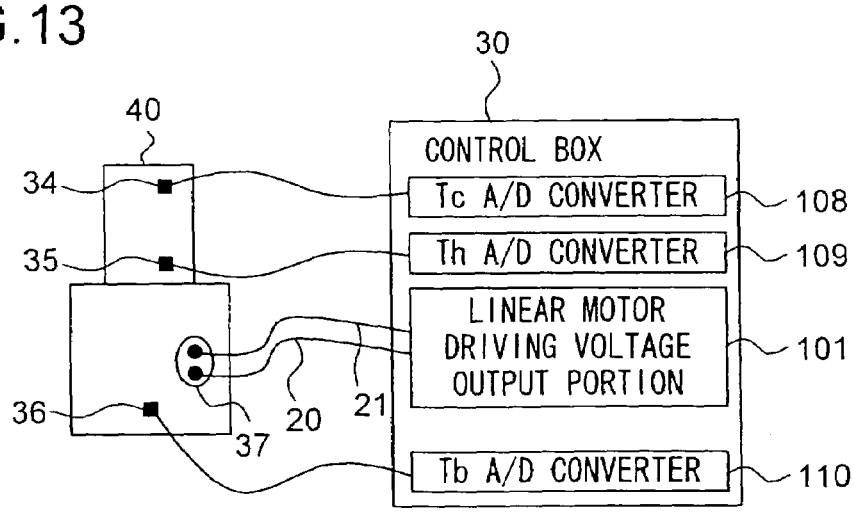
FIG. 13 is a diagram showing how the Stirling refrigerator of the fifth embodiment of the invention is connected.

FIG. 13 shows how the control box 30 and the Stirling refrigerator 40 are connected together. The Stirling refrigerator 40 is fitted with temperature sensors 34, 35, and 36 for sensing the temperatures Tc, Th, and Tb of the expansion space 10, the compression space 9, and the bounce space 8, respectively.

The control box 30 incorporates a Tc A/D converter 108, a Th A/D converter 109, and a Tb A/D converter 110 for performing A/D conversion on the outputs from the temperature sensors 34, 35, and 36, respectively. Moreover, by way of the leads 20 and 21, a linear motor driving voltage output portion 101 is connected to the hermetically sealed terminals 37. The linear motor driving voltage output portion 101 outputs a voltage with which the linear motor 13 is driven.

Figure 14:
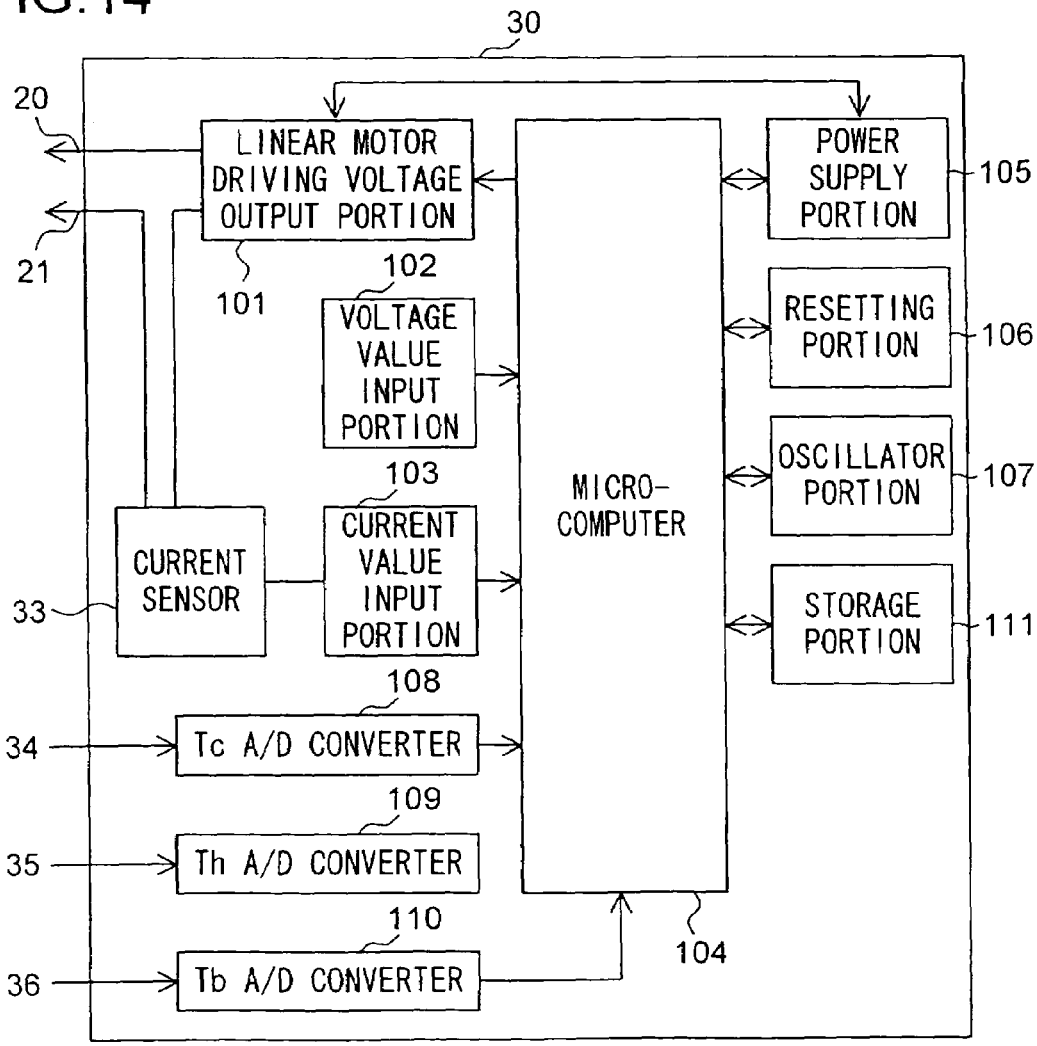
FIG. 14 is a block diagram showing the configuration of the control box of the Stirling refrigerator of the fifth embodiment of the invention.

FIG. 14 is a block diagram showing the details of the control box 30. The control box 30 incorporates a microcomputer 104 for performing various operations and the like. To the microcomputer 104 is connected a power supply portion 105 for supplying electric power to various blocks of the control box 30.

To the microcomputer 104 are also connected a voltage value input portion 102 that performs A/D conversion on the value sensed by a voltage sensor (not shown) for sensing the input voltage to a power supply portion 105 and that then feeds the result to the microcomputer 104 and a current value input portion 103 that performs A/D conversion on the value sensed by a current sensor 33 for sensing the current consumed by the linear motor 13 and that then feeds the result to the microcomputer 104. To the microcomputer 104 are also connected a resetting portion 106 for resetting the control box 30, an oscillator portion 107 for producing a PWM inverter waveform, and a storage portion 111 composed of a rewritable nonvolatile memory device (EEPROM) for storing data.

As will be described later, the microcomputer 104, according to the input from the voltage value input portion 102, feeds a control signal to the power supply portion 105. In this way, the output voltage of the power supply portion 105 is controlled. Moreover, the linear motor driving voltage output portion 101 is controlled by the microcomputer 104 to convert the output voltage of the power supply portion 105 into a PWM inverter waveform and then supply it to the linear motor 13.

Figure 15:
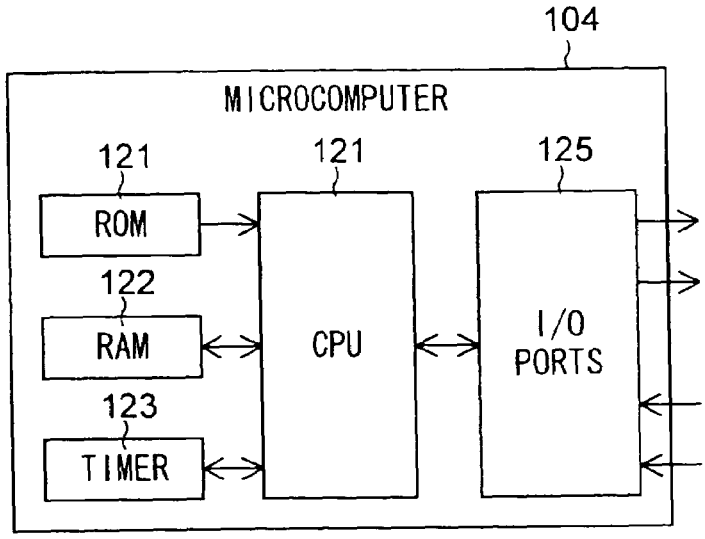
FIG. 15 is a block diagram showing the configuration of the microcomputer of the Stirling refrigerator of the fifth embodiment of the invention.

FIG. 15 is a block diagram showing the internal configuration of the microcomputer 104. Inside the microcomputer 104, a read-only ROM 121 for storing a control program, a RAM 122 for temporarily storing calculation results, a timer 123 for counting operation time and the like, and I/O ports 125 for achieving data input and output are connected to a CPU 124. The CPU 124 executes the control program read out from the ROM 121, and thereby controls the Stirling refrigerator 40.

The driving of the linear motor 13 can be controlled through step control, whereby the driving voltage of the linear motor 13 is detected and is controlled to be equal to a driving voltage corresponding to a target stroke, or through stroke control, whereby the stroke of the piston is detected and is controlled to be equal to a desired stroke.

Step control is achieved in the following manner. The microcomputer 104 compares the driving voltage of the linear motor 13 being driven, as calculated from the voltage value input from the voltage value input portion 102 and the current value input from the current value input portion 103, with the driving voltage corresponding to a target stroke of the piston 1, and then adjusts stepwise the driving voltage output from the linear motor driving voltage output portion 101.

Stroke control is achieved in the following manner. The microcomputer 104 detects the stroke of the piston 1 by calculating it from the driving voltage, consumed current, inductance, and resistance component of the linear motor 13 being driven, then compares it with the target stroke stored in the storage portion 111 (see FIG. 14), and adjusts the driving voltage output from the linear motor driving voltage output portion 101 to a driving voltage corresponding to the target stroke.

Figure 16:
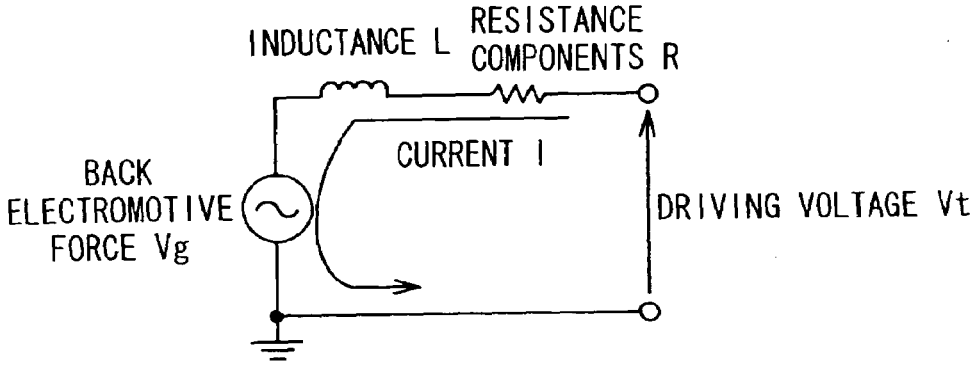
FIG. 16 is an equivalent circuit diagram of the linear motor of the Stirling refrigerator of the fifth embodiment of the invention.

As illustration of how the stroke of the piston 1 is detected, FIG. 16 shows an equivalent circuit of the linear motor 13. When a driving voltage Vt is fed from the linear motor driving voltage output portion 101 to the linear motor 13, a current I flows through the linear motor 13. As a result, voltage drops occur across the resistance component R and the inductance L, and a back electromotive force Vg appears.

Figure 17:
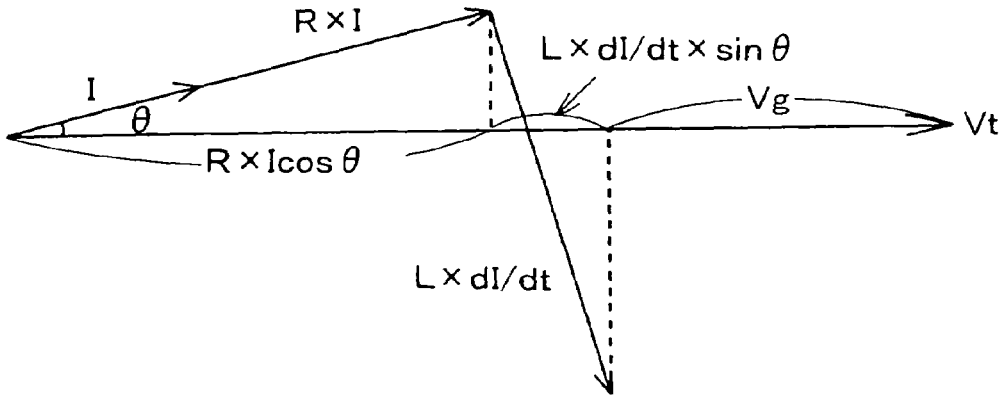
FIG. 17 is a vector diagram showing the relationship between the input voltage Vt to the linear motor and the resulting back electromotive force Vg as observed in the Stirling refrigerator of the fifth embodiment of the invention.

Since the current I has a phase difference relative to the driving voltage Vt, if the phase difference is assumed to be θ, then, as shown in a vector diagram in FIG. 17, the voltage drops across the resistance component R and the inductance L are RI cos θ and L sin θ· dI/dt, respectively. Hence, the back electromotive force Vg is given by equation (1) below. Moreover, the back electromotive force Vg is a function of the stroke Xp, and therefore it can also be given by equation (2) below.

$$Vg=Vt-RI\cos\theta-L\sin\theta\cdot dI/dt \quad (1)$$

$$Vg=f(Xp) \quad (2)$$

Figure 18:
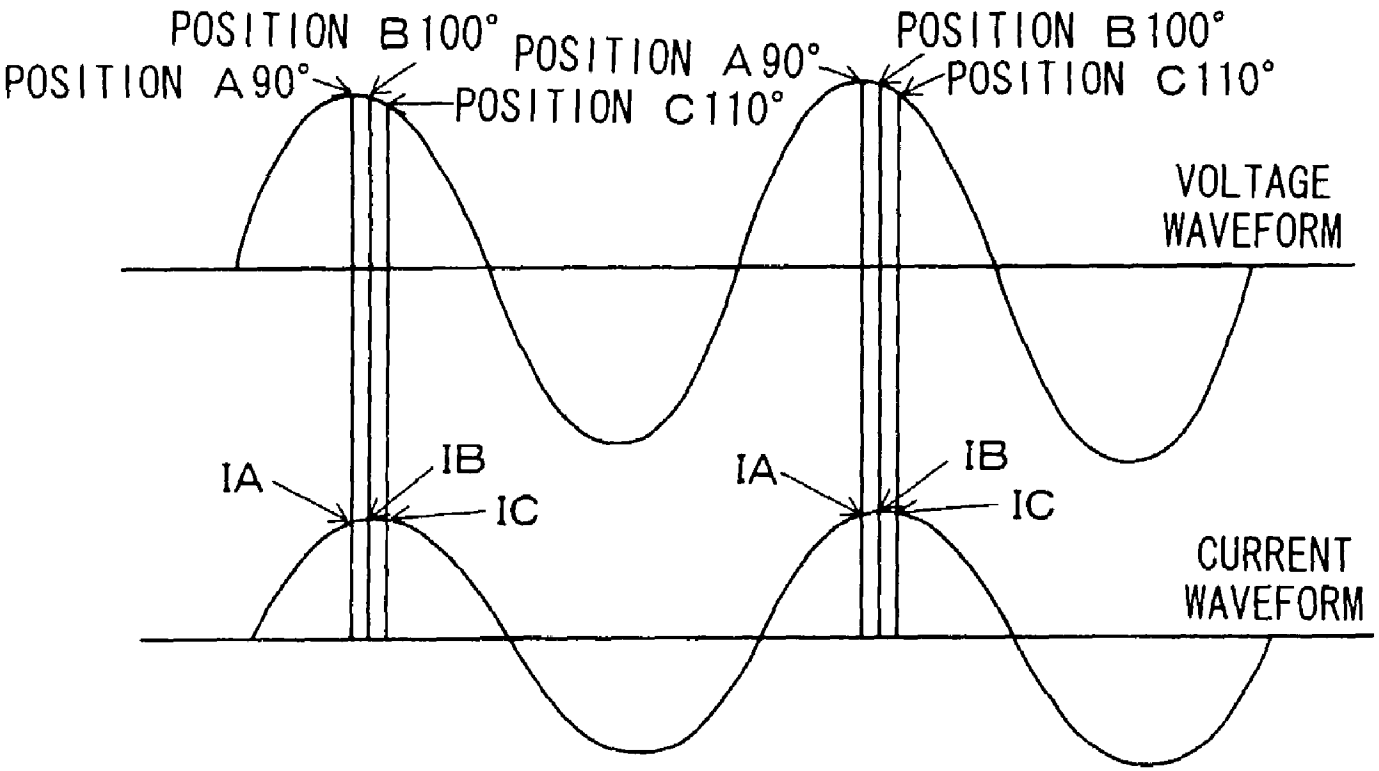
FIG. 18 is a diagram showing the output waveforms of the driving voltage and the current as observed in the Stirling refrigerator of the fifth embodiment of the invention.

FIG. 18 is a diagram showing the output waveforms of the driving voltage Vt and the current I. The phase difference θ is calculated in the following manner. Let the position at which the driving voltage Vt has its peak (at a phase angle of 90°) be position A, and let the positions predetermined angles, for example 10° and 20°, apart from position A be positions B (at a phase angle of 100°) and C (at a phase angle of 110°). Moreover, let the current I at positions A, B, and C be IA, IB, and IC, respectively. Then, the phase difference θ is given by when IA≧IB>IC, θ≦5°, when IB>IA≧IC, 5°<θ≧10°, when IB≧IC>IA, 10°<θ≦15°, when IC>IB>IA, θ>15°.

When positions A, B, and C are assumed to be delayed by 10° from each other as described above, it is possible to find the phase difference θ with a resolution of 5°. By making the delay angles smaller, it is possible to make the resolution higher, and, by increasing the number of measurement points, it is possible to measure the phase difference in a wider range.

In equations (1) and (2) above, L and R are known, and Vt and I are fed from the voltage value input portion 102 and the current value input portion 103, respectively. This permits the phase difference θ to be found. Thus, the microcomputer 104 can calculate the stroke Xp.

When the phase difference is θ≈0, the equation (1) above can be approximated as equation (3) below. Accordingly, when the load on the Stirling refrigerator 40 is light and thus the phase difference is θ≈0, the stroke Xp may be calculated by the use of equation (3) below.

$$Vg=Vt-RI \quad (3)$$

However, as the load on the Stirling refrigerator 40 becomes heavier, the phase difference θ becomes greater, and therefore it is not possible to completely ignore the effect of the phase difference θ. Accordingly, in equation (3) above, it is desirable to consider the load of the Stirling refrigerator 40 in the resistance component R. The load of the Stirling refrigerator 40 can be expressed as a function with respect to the hot-side and cold-side temperatures of the Stirling refrigerator 40.

As the hot-side temperature, the temperature Th of the warm section 9 or the temperature Tb of the bounce space 8 is used. As the cold-side temperature, the temperature Tc of the cold section 10 is used. Accordingly, equation (3) above can be replaced with equation (4) or (5) below. Thus, the microcomputer 104 can calculate the stroke Xp of the piston 1 on the basis of the relationships expressed by equation (4) or (5) and by equation (2).

$$Vg=Vt-R\,(Th,\ Tc)I \quad (4)$$

$$Vg=Vt-R\,(Tb,\ Tc)I \quad (5)$$

In the storage portion 111 (see FIG. 14), there are stored different target strokes of the piston 1 corresponding to different operation conditions of the Stirling refrigerator 40. Table 2 shows the table of target strokes stored in the storage portion 111.

TABLE 2

| | Th, Tb | | | |
|---|---|---|---|---|
| Tc | to 30° C. | 30 to 40° C. | 40 to 50° C. | 50 to 60° C. |
| 10 to 20° C. | 5.9 mm | 5.7 mm | 5.5 mm | 5.3 mm |
| 0 to 10° C. | 6.0 mm | 5.8 mm | 5.6 mm | 5.4 mm |
| −10 to 0° C. | 6.2 mm | 6.0 mm | 5.8 mm | 5.6 mm |
| −20 to −10° C. | 6.4 mm | 6.2 mm | 6.0 mm | 5.8 mm |
| −30 to −20° C. | 6.5 mm | 6.3 mm | 6.2 mm | 5.9 mm |

As shown in Table 2, different target strokes are arranged in a two-dimensional (matrix) table so as to correspond to different ranges of the cold-side and hot-side temperatures of the Stirling refrigerator 40.

The temperature Tc of the cold section 10 is divided into five ranges, namely 10 to 20° C., 0 to 10° C., −10 to 0° C., −20 to −10° C., and −30 to −20° C. The temperature Th or Tb of the warm section 9 or the bounce space 8 is divided into four ranges, namely to 30° C., 30 to 40° C., 40 to 50° C., and 50 to 60° C. The temperature ranges and temperature divisions used here are mere examples, and it is possible to use any other temperature ranges and divisions than specifically described above.

Figure 19:
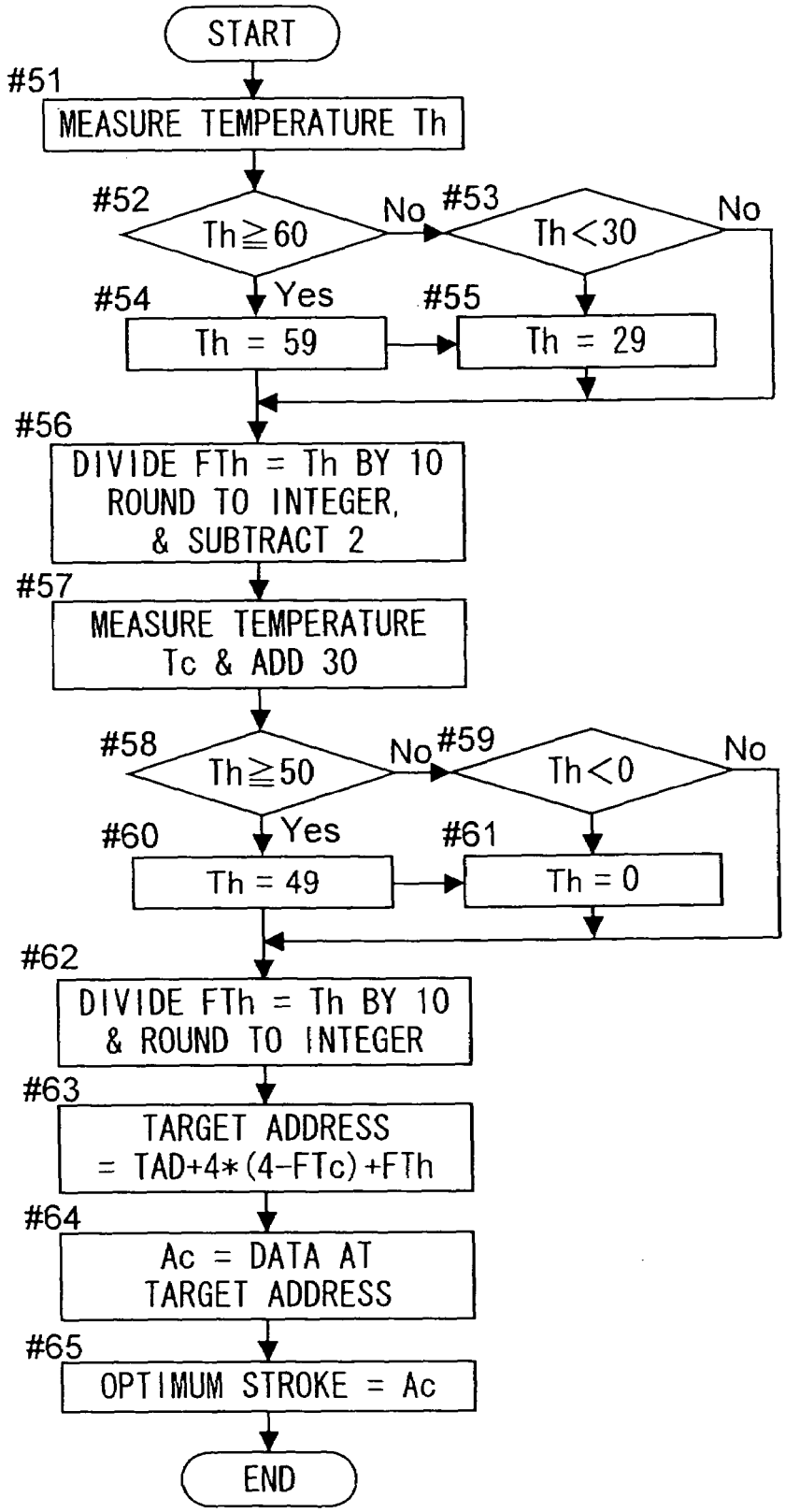
FIG. 19 is a flow chart showing one example of the program for controlling the stroke in the Stirling refrigerator of the fifth embodiment of the invention.

FIG. 19 is a flow chart of a program that refers to this target stroke table, which takes temperatures as variables. First, the warm section temperature Th is measured by sensing it with the Th temperature sensor 35 and converting it into digital data with the Th A/D converter 109 (step #51). Then, whether the temperature is in the range of from 30° C. inclusive to 60° C. exclusive or not is checked (steps #52 and #53). If the temperature is equal to or higher than 60° C., it is rounded to 59° C., and, if it is equal to or lower than 30° C., it is rounded to 29° C. (steps #54 and #55). The resulting value is divided by 10, and is then rounded to an integer number by dropping its fractional portion. Then, two is subtracted from the result to obtain FTh (step #56).

Next, the temperature Tc is measured by sensing it with the Tc temperature sensor 34 and converting it into digital data with the Th A/D converter 108, and then 30 is added to the result (step #57). Then, whether the temperature is in the range of from 0° C. inclusive to 50 ° C. exclusive or not is checked (steps #58 and #59). If it is equal to or higher than 50° C., it is rounded to 49° C., and, if it is equal to or lower than 0° C., it is rounded to 0° C. (step #61). The resulting value is divided by 10, and is rounded to an integer number by dropping its fractional portion to obtain FTc (step #62). Then, the target address is calculated by adding 4(4-FTc) and FTh to the top address TAD of the area of the ROM in which the table is stored (step #63). The data at that address is read as Ac (step #64) and is determined as the target stroke (step #65).

Instead of the warm section temperature Th, the temperature Tb of the bounce space may be used to achieve a similar result.

In the Stirling refrigerator 40, the lower the cold-side temperature, the more stable the gas pressure of the working medium; likewise, the higher the hot-side temperature, the more stable the gas pressure of the working medium. Thus, when the gas pressure of the working medium is unstable, as immediately after start-up, the linear motor 13 drives the piston 1 with a small stroke. This reduces the danger of collision between the piston 1 and the displacer 2. Then, as time passes after start-up and the gas pressure of the working medium stabilizes, the stroke is increased gradually to achieve operation with high refrigerating performance.

It is advisable that, immediately after start-up, the stroke be made smaller and the speed of the reciprocating movement of the linear motor 13 higher to stabilize the gas pressure quickly and that, as the stroke is increased, the speed of the reciprocating movement be decreased to avoid collision resulting from overtravel.

If the piston 1 and the displacer 2 approach each other within a predetermined distance, or their collision is detected, operation is switched back to the step control described earlier. This permits the linear motor 13 to be driven with a driving voltage lower than that used immediately before so that it is again driven in such a way as to avoid collision.

The target stroke may be determined through calculation instead of being chosen from the table. For example, the target stroke Xb, when expressed as a function with respect to the temperatures Tc and Th, is given by equation (6) or (7) below. By calculating the target stroke on the basis of equation (6) or (7), it is possible to adjust the stroke more smoothly, and in addition reduce the amount of data stored in the storage portion 111.

$$Xb=(\alpha_1 Tc+\alpha_2)(\alpha_3 Th+\alpha_4) \quad (6)$$

$$Xb=(\beta_1 Tc^2+\beta_2 Tc+\beta_3)(\beta_4 Th^2+\beta_5 Th+\beta_6) \quad (7)$$

(where $\alpha_1$ to $\alpha_4$ and $\beta_1$ to $\beta_6$ are constants.)

Next, the Stirling refrigerator of a sixth embodiment of the invention will be described. In this embodiment, in addition to stroke control, a collision detecting means, which will be described later, is used to avoid dangerous condition resulting from collision between the piston 1 and the displacer 2.

In the fifth embodiment described above, the microcomputer 104 gradually increases the driving voltage of the linear motor 13 and, when the stroke becomes close to that at which there is danger of collision between the piston 1 and the displacer 2, the microcomputer 104 slowly increases the driving voltage until the target stroke is obtained. While the driving voltage is being increased in this way, the stroke of the piston 1 does not balance well with that of the displacer 2, and therefore there is relatively high danger of collision. Accordingly, if collision is detected, it is necessary to immediately make the stroke of the piston 1 smaller to avoid dangerous condition resulting from collision.

Now, a method for detecting collision in such a case will be specifically described. This method exploits the fact that, as the driving voltage is increased, the current consumed by the linear motor 13 increases. The relationship between the driving voltage Vt and the consumed current I in an equivalent circuit of the linear motor 13 is predicted by calculation. Moreover, the consumed current value that is expected to result when the driving voltage is increased by a predetermined value is predicted by calculation, and then a few percent of the predicted consumed current value is added thereto to calculate and store a collision detection current value A. On the other hand, the actual consumed current value is measured with a current sensor 33,and is compared with the collision detection current value A. If the measured value is greater than the collision detection current value A, it is judged that collision is occurring, and operation for avoiding danger is performed. The method for avoiding danger will be specifically described later.

Once the target stroke of the piston 1 is obtained, the linear motor 13 is driven with a constant driving voltage, with only a very small gap left between the piston 1 and the displacer 2 when they approach each other. Thus, even a slight variation in the load or in the input voltage may lead to collision.

Now, a method for detecting collision in such a case will be specifically described. This method exploits the fact that, when the piston 1 and the displacer 2 collide with each other, the consumed current of the linear motor 13 varies periodically. Specifically, once the movement of the piston 1 reaches the target stroke, the linear motor 13 is driven with a constant driving voltage, and therefore its consumed current should normally remain constant. However, if collision occurs between the piston 1 and the displacer 2, the current value greatly varies periodically, i.e., every time they collide. This permits detection of collision.

First, when the target stroke is obtained, the consumed current is sensed and stored. Then, the value is multiplied by a few percent to calculate and store a collision detection current variation value B. Then, the current as observed in stable operation is measured and stored repeatedly every 0.1 seconds, and its variation is calculated every one second according to the formula below.

Variation–Maximum Current in a Second–Minimum Current in the Second

This variation is compared with the collision detection current variation value B. If the variation is greater than the collision detection current variation value B, it is judged that collision is occurring, and operation for avoiding it is performed. The periods noted above, i.e., 0.1 seconds and one second, are mere examples, and it is possible to use any other periods than specifically described above. It is advisable to activate this collision detection method when the driving voltage Vt is higher than a predetermined voltage.

Collision between the piston 1 and the displacer 2 is detected by the two collision detection methods described above. When collision is actually detected, operation switches from stroke control to step control, and the driving voltage that has thus far been controlled through stroke control is reduced by a number of steps so that the linear motor 13 is driven with a driving voltage lower by a predetermined voltage.

The number of steps by which the driving voltage is reduced is a function with respect to the temperature Th of the warm section and the temperature Tc of the cold section, and is determined basically so that, the higher the temperatures Th and Tc of the warm section and the cold section, the greater the number of steps. Table 3 shows an example.

TABLE 3

| Tc | Th to 30° | 30 to 40° C. | 40 to 50° C. | 50 to 60° C. |
|---|---|---|---|---|
| 20 to 10° C. | 4 steps | 6 steps | 8 steps | 8 steps |
| 10 to 0° C. | 4 steps | 5 steps | 6 steps | 7 steps |
| 0 to −10° C. | 4 steps | 5 steps | 6 steps | 7 steps |
| −10 to −20° C. | 3 steps | 4 steps | 5 steps | 6 steps |
| −20 to −30° C. | 3 steps | 4 steps | 5 steps | 6 steps |

Instead of the warm section temperature Th, the bounce space temperature Tb may be used. The number of steps may be converted into a linear or quadratic function with respect to Th or Tc.

In this way, when collision is detected, operation is switched from stroke control to step control, and the driving voltage of the linear motor 13 is reduced by a number of steps, immediately making the stroke of the piston 1 smaller. This makes it possible to avoid dangerous condition resulting from collision and ensure safe operation.

after operation is switched from stroke control to step control on detection of collision, it is necessary to return from step control to stroke control. This is achieved by a method relying on a lapse of time. Specifically, stroke control is restored when a predetermined length of time (for example, 20 seconds) elapses after the switching to the step control. During operation using step control, detection of collision is deactivated.

Here, the predetermined length of time may be linked to a variation in the load, for example by using a two-dimensional table taking the temperature Th of the warm section and the temperature Tc of the cold section as variables. Table 4 shows an example. Basically, the length of time is so controlled as to be the longer the higher the temperature Th of the warm section and the lower the temperature Tc of the cold section.

TABLE 4

| Tc | Th to 30° | 30 to 40° C. | 40 to 50° C. | 50 to 60° C. |
|---|---|---|---|---|
| 20 to 10° C. | 8 seconds | 12 seconds | 15 seconds | 20 seconds |
| 10 to 0° C. | 10 seconds | 15 seconds | 17 seconds | 22 seconds |
| 0 to −10° C. | 13 seconds | 20 seconds | 23 seconds | 25 seconds |
| −10 to −20° C. | 15 seconds | 22 seconds | 26 seconds | 28 seconds |
| −20 to −30° C. | 20 seconds | 24 seconds | 28 seconds | 30 seconds |

Instead of the warm section temperature Th, the bounce space temperature Tb may be used. The duration for which detection of collision is deactivated (i.e., the above-mentioned predetermined length of time) may be converted into a linear or quadratic function with respect to the warm section temperature Th or the bounce space temperature Tb.

Next, the Stirling refrigerator of a seventh embodiment of the invention will be described. In this embodiment, the microcomputer 104 corrects the target stroke for assembly errors and machining errors inevitable in the Stirling refrigerator 40.

In the Stirling refrigerator 40, assembly errors and machining errors are inevitable, resulting in variations from one product to another in dimensions such as the interval between the piston 1 and the displacer 2. Thus, if stroke control is performed by the use of the target stroke chosen from the same table as that shown in Table 2 in the Stirling refrigerator 40 of all products, the piston 1 and the displacer 2 may collide with each other.

To avoid this, in the storage portion 111, there is stored correction data for correcting the target stroke. For example, in the storage portion 111 is stored a table of different factors $k_1$ corresponding to different intervals between the piston 1 and the displacer 2. In the manufacturing process, the interval between the piston 1 and the displacer 2 in each individual Stirling refrigerator 40 is measured and stored in the storage portion 111. Thus, the factor $k_1$ that corresponds to each individual Stirling refrigerator 40 is chosen from the table.

When the Stirling refrigerator 40 operates, the microcomputer 104 reads a target stroke Xb from Table 2 stored in the storage portion 111 and a factor $k_1$ from the table, likewise stored in the storage portion 111, of factors $k_1$ that corresponds to the interval between the piston 1 and the displacer 2. The microcomputer 104 then corrects the target stroke Xb as expressed by equation (8) below. Then, stroke control is performed on the basis of the corrected target stroke Xb'.

$$Xb'=k_1Xb \tag{8}$$

As the voltage supplied to the Stirling refrigerator 40 varies, the output voltage of the power supply portion 105 varies. This may cause the driving voltage output from the linear motor driving voltage output portion 101 to the linear motor 13 to deviate from the voltage that corresponds to the target stroke. To avoid this, in the storage portion 111, there is stored correction data for correcting the output voltage of the power supply portion 105. For example, in the storage portion 111 is stored a table of different factors $k_2$ corresponding to different input voltages to the power supply portion 105.

When the Stirling refrigerator 40 operates, the microcomputer 104 reads a target stroke from Table 2, and calculates the driving voltage corresponding to the target voltage. Simultaneously, the microcomputer 104 reads from the storage portion 111 the factor $k_2$ that corresponds to the input voltage of the power supply portion 105, and corrects the output voltage Vb of the power supply portion 105 as expressed by equation (9) below. Then, the corrected output voltage Vb'is supplied to the linear motor driving voltage output portion 101, so that a driving voltage corresponding to the target stroke is supplied to the linear motor 13.

$$Vb'=k_2Vb \tag{9}$$

As the current I consumed by the linear motor 13 varies, the voltage drops across the inductance L and the resistance component R (see FIG. 16) vary, and thus the voltage applied to the linear motor 13 varies. This may cause the actual stroke to deviate from the desired stroke. To avoid this, in the storage portion 111, there is stored correction data for correcting the driving voltage of the linear motor 13. For example, in the storage portion 111 is stored a table of different factors $k_3$ corresponding to different consumed currents.

When the Stirling refrigerator 40 operates, the microcomputer 104 reads a target stroke from Table 2, and calculates the driving voltage Vc corresponding to the target voltage. Simultaneously, the microcomputer 104 reads from the storage portion 111 the factor $k_3$ that corresponds to the input from the current value input portion 103, and corrects the driving voltage Vc as expressed by equation (10) below. Then, the linear motor 13 is driven with the corrected driving voltage Vc'.

$$Vc'=k_3Vc \tag{10}$$

For each of the factors $k_1$, $k_2$, and $k_3$ mentioned above, a plurality of values are stored in the form of a table. However, it is also possible to store instead equations for determining the factors $k_1$, $k_2$, and $k_3$ through calculation in the storage portion 111 or the ROM 121.

Figure 20:
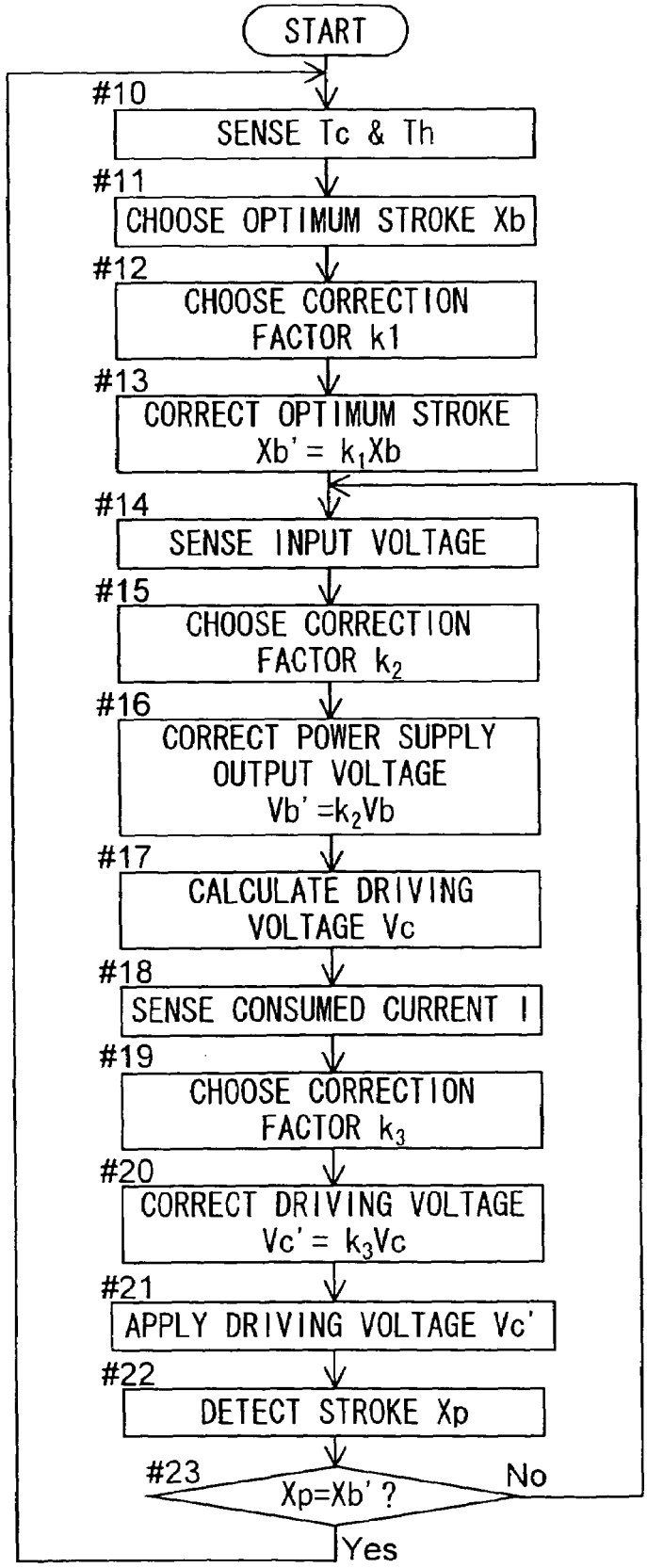
FIG. 20 is a flow chart showing the operation of the Stirling refrigerator of a seventh embodiment of the invention.

Now, the operation of the Stirling refrigerator 40 configured as described above will be described with reference to a flow chart shown in FIG. 20. First, in step #10, the temperature Tc of the cold section and the temperature Th of the warm section are sensed with the temperature sensors 34 and 35, and are fed through the Tc A/D converter 108 and the Th A/D converter 109 to the microcomputer 104.

In step #11, by the microcomputer 104, the target stroke Xb that corresponds to the temperatures Tc and Th is chosen from the table of target strokes stored in the storage portion 111. In step #12, the correction factor $k_1$ that corresponds to the interval between the piston 1 and the displacer 2 is chosen from the table of correction factors stored in the storage portion 111. In step #13, the target stroke is corrected according to equation (8) to obtain a really targeted stroke Xb'.

In step #14, the input voltage to the Stirling refrigerator 40 (i.e., the input voltage to the power supply portion 105) is sensed. In step #15, the correction factor $k_2$ that corresponds to the input voltage is chosen from the table of correction factors $k_2$ stored in the storage portion 111. In step #16, the output voltage of the power supply portion 105 is corrected according to equation (9) to obtain a stable output voltage Vb'.

In step #17, by the microcomputer 104, the driving voltage Vc that permits operation with the target stroke is calculated. In step #18, the current I consumed by the linear motor 13 is sensed by the current sensor 33, and is fed through the current value input portion 103 to the microcomputer 104.

In step #19, the correction factor $k_3$ that corresponds to the consumed current I is chosen from the table of correction factors $k_3$ stored in the storage portion 111. In step #20, the driving voltage output from the linear motor driving voltage output portion 101 is corrected according to equation (10) to obtain a driving voltage Vc' that produces no deviation in the target stroke.

In step #21, the driving voltage Vc' is output from the linear motor driving voltage output portion 101 and is applied to the linear motor 13. In step #22, the stroke Xp of the piston 1 is detected according to equations (1) and (2) noted earlier. In step #23, whether the detected stroke Xp is equal to the target stroke Xb' or not is checked.

If the detected stroke Xp is not equal to the target stroke Xb', steps #14 to #23 are repeated to calculate the driving voltage Vc again on the basis of the detected stroke Xp (step #17). If the detected stroke Xp is equal to the target stroke Xb', the flow returns to step #10 to repeat the whole operation for adjusting the target stroke according to the operation condition of the Stirling refrigerator 40 at the moment.

In this embodiment, through stroke control, whereby the stroke of the piston 1 is detected and is controlled to be equal to the target stroke, it is possible to avoid collision between the piston 1 and the displacer 2 and enhance the refrigerating performance of the Stirling refrigerator 40.

Moreover, a table of different target strokes corresponding to different operation conditions of the Stirling refrigerator 40 is stored in the storage portion 111, so that the linear motor 13 can be driven with the target stroke that suits the actual operation condition. This makes it possible to avoid collision between the piston 1 and the displacer 2 and further enhance the refrigerating performance of the Stirling refrigerator 40.

Moreover, the storage portion 111 is provided separately from the ROM 121 incorporated in the microcomputer 104. This helps alleviate the load on the microcomputer 104 and store a large amount of data. Thus, it is possible to store different target strokes corresponding to different operation conditions to achieve finely controlled operation.

Furthermore, the target stroke is corrected for variations in dimensions resulting from assembly errors and machining errors inevitable in the Stirling refrigerator 40. This makes it possible to avoid collision between the piston 1 and the displacer 2 resulting from product-to-product variations of the Stirling refrigerator 40.

In addition, the microcomputer 104 corrects the output voltage of the power supply portion 105 or the driving voltage of the linear motor 13 according to the variation of the voltage fed to the Stirling refrigerator 40 or the variation of the current consumed by the linear motor 13. This makes it possible to drive the linear motor 13 with a more stable target stroke.

Next, the Stirling refrigerator of an eighth embodiment of the invention will be described. The structure and configuration here are the same as in the fifth to seventh embodiments shown in FIGS. 12 to 20 described above. The only difference is, as shown in Table 5, the table of target strokes stored in the storage portion 111.

TABLE 5

| | Time (Seconds) | | | | | |
|---|---|---|---|---|---|---|
| | 1 to 10 | 10 to 60 | 60 to 120 | 120 to 240 | 240 to 600 | over 600 |
| Optimum Stroke | 4.0 mm | 4.5 mm | 5.0 mm | 5.5 mm | 6.0 mm | 6.5 mm |

In this table, different target strokes are arranged in a one-dimensional (linear) table that takes as a variable the lapse of time after the start-up of the Stirling refrigerator 40, in increasing order with time. The lapse of time is measured with the timer 123 (see FIG. 15), and the stroke of the piston 1 is so adjusted as to be equal to the target stroke corresponding to the time that has elapsed. Here, the same control as performed in the fifth embodiment can be used, provided that, in step #10 in the flow chart shown in FIG. 20 described earlier, the lapse of time after start-up is detected with the timer 123.

In this way, in the unstable period immediately after start-up, the target stroke is made smaller to avoid collision between the piston 1 and the displacer 2, and, as the condition becomes stable, the target stroke is increased to achieve higher refrigerating performance. It is also possible to choose a target stroke from the table shown in Table 5 according to the lapse of time immediately after start-up and then, when a predetermined length of time has elapsed (for example, 120 seconds thereafter), choose a target stroke from the table shown in Table 2 according to the cold-side and hot-side temperatures. This makes it possible to achieve more finely controlled operation.

Figure 21:
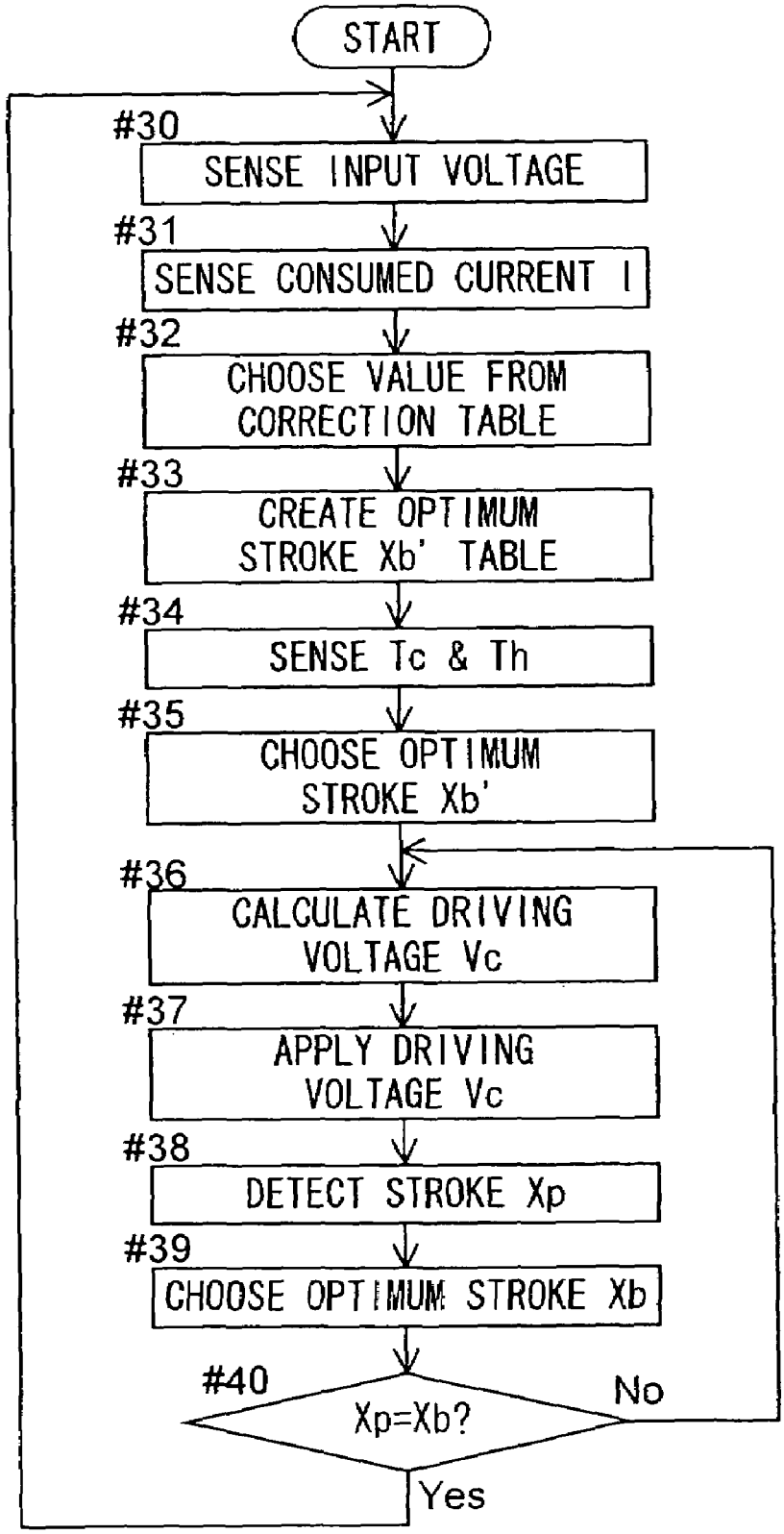
FIG. 21 is a flow chart showing the operation of the Stirling refrigerator of a ninth embodiment of the invention.

Next, a ninth embodiment of the invention will be described. FIG. 21 is a flow chart of the operation of the Stirling refrigerator of the ninth embodiment. In this embodiment, a table of corrected target strokes (see Table 2) is created according to the input voltage V to the Stirling refrigerator 40 and the current I consumed by the linear motor 13, and this table is updated whenever necessary.

First, in step #30, the input voltage V to the Stirling refrigerator 40 is sensed. In step #31, the current I consumed by the linear motor 13 is sensed with the current sensor 33, and is fed through the current value input portion 103 to the microcomputer 104. In step #32, a standard target stroke $Xb'(I_m, V_n)$ is chosen from a correction table, as shown in Table 6, stored in the storage portion 111 according to the input voltage V and the consumed current I. The contents of Table 6 are classified into four steps in the column direction according to the input voltage V and into four steps in the row direction according to the consumed current I. For example, when $I=I_4$ and $V=V_4$, the standard target stroke $Xb'(I_4, V_4)$ chosen is 5.7 mm.

TABLE 6

| | V | | | |
|---|---|---|---|---|
| I | V1 | V2 | V3 | V4 |
| I1 | 6.3 mm | 6.2 mm | 6.1 mm | 6.0 mm |
| I2 | 6.2 mm | 6.1 mm | 6.0 mm | 5.9 mm |
| I3 | 6.1 mm | 6.0 mm | 5.9 mm | 5.8 mm |
| I4 | 6.0 mm | 5.9 mm | 5.8 mm | 5.7 mm |

Stored as the standard target stroke Xb'(I, V) is, for example, the target stroke Xb'(I, V) to be used when the temperature Tc of the cold section is −15° C. and the temperature Th of the warm section is 45° C.

When there is a variation in the input voltage V to the Stirling refrigerator 40 or in the current I consumed by the linear motor 13, even if the linear motor driving voltage output portion 101 (see FIG. 14) outputs the driving voltage corresponding to a desired target stroke Xb, the piston 1 is not driven with the target stroke Xb. Accordingly, it is necessary to correct the target stroke Xb according to the input voltage V and the consumed current I.

In step #33, on the basis of the standard target stroke Xb'(I, V), a table of target strokes Xb'like that shown in Table 2 described earlier is created, and is stored in the storage portion 111. Specifically, the value 6.0 mm of the target stroke at Tc=−15° C. and Th=45 ° C. shown in Table 2 is corrected to 5.7 mm, and thus a table as shown in Table 7 is created. The target strokes Xb' shown in Table 7 are in a predetermined proportion (95%) of the target strokes Xb shown in Table 2 under the same conditions.

TABLE 7

| | Th, Tb | | | |
|---|---|---|---|---|
| Tc | to 30° C. | 30 to 40° C. | 40 to 50° C. | 50 to 60° C. |
| 10 to 20° C. | 5.6 mm | 5.4 mm | 5.2 mm | 5.0 mm |
| 0 to 10° C. | 5.7 mm | 5.5 mm | 5.3 mm | 5.1 mm |
| −10 to 0° C. | 5.9 mm | 5.7 mm | 5.5 mm | 5.3 mm |
| −20 to −10° C. | 6.1 mm | 5.9 mm | 5.7 mm | 5.5 mm |
| −30 to −20° C. | 6.2 mm | 6.0 mm | 5.9 mm | 5.6 mm |

In step #34, the temperature Tc of the cold section and the temperature Th of the warm section are sensed with the temperature sensors 34 and 35, and are fed through the Tc A/D converter 108 and the Th A/D converter 109 to the microcomputer 104. In step #35, from the table of target strokes Xb'(see Table 7) stored in the storage portion 111 by the microcomputer 104, the target stroke Xb' that corresponds to the temperatures Tc and Th is chosen.

In step #36, the driving voltage Vc to be output from the linear motor driving voltage output portion 101 is calculated on the basis of the target stroke Xb'. In step #37, the driving voltage Vc is output from the linear motor driving voltage output portion 101, and is applied to the linear motor 13. In step #38, the stroke Xp of the piston 1 is detected according to equations (1) and (2) noted earlier.

In step #39, from the table of target strokes Xb (see Table 2) stored in the storage portion 111 by the microcomputer 104, the target stroke Xb that corresponds to the temperatures Tc and Th is chosen. In step #40, whether the detected stroke Xp is equal to the target stroke Xb or not is checked.

If the detected stroke Xp is not equal to the target stroke Xb, steps #36 to #40 are repeated to calculate the driving voltage Vc again on the basis of the detected stroke Xp, and the linear motor 13 is driven with that driving voltage Vc. If the detected stroke Xp is equal to the target stroke Xb, the flow returns to step #30 to repeat the whole operation with the table of target strokes Xb' updated according to the operation condition of the Stirling refrigerator 40 at the moment.

INDUSTRIAL APPLICABILITY

As described above, by the operation of various information sensing means, a danger-of-collision detecting means, and a current controlling means, it is possible to avoid collision of the piston and the displacer, and thereby prevent destruction of the refrigerator. Moreover, on rapid cooling as immediately after the start of operation, it is possible to bring out the maximum refrigerating performance of the Stirling refrigerator within the range in which the danger of collision is avoided.

Moreover, by monitoring the voltage of the electric power supplied from an external power source, by monitoring the temperatures in relevant portions in the Stirling engine, and by monitoring the vibration of a mass spring, it is possible to detect an abnormality and stop the Stirling refrigerator so as to prevent collision of its internal components.

Moreover, through stroke control, whereby the stroke of the piston is detected and is so controlled as to be equal to a target stroke, it is possible to avoid collision between the piston and the displacer and enhance the refrigerating performance of the Stirling refrigerator. Moreover, different target strokes corresponding to different operation conditions of the Stirling refrigerator are stored in the storage portion, and therefore it is possible to drive the linear motor with the target stroke that suits the operation condition at the moment. This makes it possible to avoid collision between the piston and the displacer and enhance the refrigerating performance of the Stirling refrigerator.

Moreover, the storage portion is provided separately from the ROM or the like incorporated in the microcomputer. This helps alleviate the load on the microcomputer and store a large amount of data. Thus, it is possible to store different target strokes corresponding to different operation conditions to achieve finely controlled operation.

Moreover, according to embodiments of the present invention, different target strokes corresponding to different lengths of time after start-up of the Stirling refrigerator and different target strokes corresponding to different cold-side and hot-side temperatures of the Stirling refrigerator are stored. Thus, for example, it is possible to drive the linear motor with a small stroke when the gas pressure of the working medium is unstable immediately after start-up and then, according to the time that has elapsed after start-up, gradually increase the stroke as the gas pressure of the working medium stabilizes. This helps reduce the danger of collision between the piston and the cylinder at start-up of the Stirling refrigerator and achieve operation with high refrigerating performance.

Moreover, correction data for correcting the target stroke according to variations in dimensions of the Stirling refrigerator is stored in the storage portion. This makes it possible to avoid collision between the piston and the displacer resulting from product-to-product variations of the Stirling refrigerator.

Moreover, the driving voltage of the linear motor is corrected according to the input voltage to the Stirling refrigerator and the current consumed by the linear motor. This makes it possible to drive the piston with a target stroke with higher stability.

Moreover, according to embodiments of the present invention, the correction data for correcting the driving voltage of the linear motor is updated according to the input voltage to the Stirling refrigerator and the current consumed by the linear motor. This makes it possible to drive the piston with a target stroke with higher accuracy.

The invention claimed is:

1. A Stirling engine comprising:

a piston that is fitted inside a cylinder and that is driven to reciprocate by a driving means;

a displacer that is fitted inside the cylinder and that reciprocates with a phase difference kept relative to the piston;

a compression chamber formed by partitioning off a space between the piston and the displacer;

an expansion chamber formed by partitioning off a space on a side of the displacer opposite to the compression chamber;

an inverter power supply circuit for supplying electric power to the driving means;

a danger-of-collision detecting means for detecting danger of collision of the displacer with the piston or with a closed end of the cylinder;

an inverter power supply circuit controlling means for controlling the electric power supplied from the inverter power supply circuit to the driving means based on information detected by the danger-of-collision detecting means;

a casing for holding the cylinder; and a balance mass fitted to the casing for absorbing vibration of the casing resulting from reciprocating movement of the piston and the displacer, wherein the balance mass vibration detecting means is the danger-of-collision detecting means.

2. A free-piston-type Stirling engine including a piston and a displacer that reciprocate inside a cylinder filled with a working gas and a linear motor that drives the piston to reciprocate, comprising:

a controlling means for storing, in a form of an operation table, different target strokes of the piston corresponding to different operation conditions of the Stirling engine and controlling the linear motor according to the operation table, wherein the operation table is a one-dimensional table taking as a variable a lapse of time from starting of operation of the Stirling engine.

3. A free-piston-type Stirling engine including a piston and a displacer that reciprocate inside a cylinder filled with a working gas, a linear motor that drives the piston to reciprocate, a stroke detecting means for detecting a stroke of the piston, and a controlling means for comparing the stroke detected by the stroke detecting means with a target stroke and controlling the linear motor in such a way that the stroke of the piston is kept equal to the target stroke, wherein the controlling means stores, in a form of an operation table, different target strokes of the piston corresponding to different operation conditions of the Stirling engine and controls the linear motor according to the operation table, and wherein the operation table is a one-dimensional table taking as a variable a lapse of time from starting of operation of the Stirling engine.

4. A free-piston-type Stirling engine including a piston and a displacer that reciprocate inside a cylinder filled with a working gas, a linear motor that drives the piston to reciprocate, a stroke detecting means for detecting a stroke of the piston, and a controlling means for comparing the stroke detected by the stroke detecting means with a target stroke and controlling the linear motor in such a way that the stroke of the piston is kept equal to the target stroke, wherein a collision detecting means is provided for detecting collision of the piston with the displacer, so that, when the collision detecting means detects collision, the controlling means lowers, by a predetermined value, a voltage with which the linear motor is driven.

5. The Stirling engine according to claim 4, wherein the collision detecting means detects collision by detecting that a current consumed by the linear motor exceeds a predetermined value when a voltage applied to the linear motor is raised by a predetermined value.

6. The Stirling engine according to claim 4, wherein the collision detecting means detects collision by detecting that a variation in a current consumed by the linear motor exceeds a predetermined level when a voltage applied to the linear motor is kept constant.

* * * * *